United States Patent [19]

Peterson

[11] 4,322,831

[45] Mar. 30, 1982

[54] PROGRAMMED DIGITAL SECONDARY CLOCK

[75] Inventor: Ronald H. Peterson, Hubbardston, Mass.

[73] Assignee: Simplex Time Recorder Co., Gardner, Mass.

[21] Appl. No.: 913,141

[22] Filed: Jun. 6, 1978

[51] Int. Cl.[3] ..... G04C 11/00; G04C 13/00

[52] U.S. Cl. ..... 368/46; 368/51

[58] Field of Search ..... 58/24 R, 24 A, 25, 26 R, 58/34, 35 R, 35 W, 39.5, 22.9, 23 R, 85.5, 33; 368/46-61, 185-187

[56] References Cited

U.S. PATENT DOCUMENTS

| | | | |
|---|---|---|---|
| 3,472,019 | 10/1969 | Webb | 58/24 R |
| 3,520,128 | 7/1970 | Noviko et al. | 58/33 |
| 3,643,420 | 2/1972 | Haydon | 58/24 R |
| 3,681,914 | 8/1972 | Loewengart | 58/24 R |
| 3,756,012 | 9/1973 | Kiss | 58/24 A |
| 3,811,265 | 5/1974 | Cater | 58/24 R |
| 3,852,953 | 12/1974 | Mischiatti | 58/24 R |
| 3,861,134 | 1/1975 | Chacon et al. | 58/24 R |
| 4,023,344 | 5/1977 | Mukaiyama | 58/24 R X |
| 4,087,958 | 5/1978 | Ebihara et al. | 58/25 |
| 4,125,993 | 11/1978 | Emile, Jr. | 58/25 |

*Primary Examiner*—Vit W. Miska

*Attorney, Agent, or Firm*—Seidel, Gonda, Goldhammer & Panitch

[57] ABSTRACT

A programmed digital secondary clock which functions as a master clock, a sub-master clock or a slave clock. The master clock maintains an updated real time count based on a 50 hz or 60 hz ac line or digital oscillator signal, displays the count, and serially transmits digital information representative of the updated real time count for use by a slave clock. The sub-master clock, receives an hourly or twice-a-day correction signal from a conventional master clock or a conventional electronic receiver, corrects the real time count, displays the corrected count, and serially transmits digital information representative of the corrected real time count for use by a slave clock. Identical programmed digital secondary clocks can be connected in daisy chain. The first clock can operate as a master clock or as a sub-master clock. The following clocks can be operated as slave clocks. The slave clock, receives serial digital information representative of real time every second, maintains an updated real time count based on the received information, displays the count, and serially transmits digital information representative of the real time count for use by a following slave clock. The programmed digital secondary clock can be operated as an elapsed timer or as an interval timer without interfering with the operation of the clock as a master, sub-master or slave clock.

17 Claims, 16 Drawing Figures

22
50hz or 60hz
CRYSTAL OSCILLATOR
20
LINE
NEUTRAL
50hz or 60hz
LINE BUFFER
18
RECEIVER
TO 14
MASTER CLOCK
TO 14
16
12'
24'
TO 14
10'
14
30
40
38
S1
S2
S3
S4
S5
54
52
34
INT
D0
D5
D4
PI 1
PI 2
PI 3
PI 4
12
D 6
D 3
D 2
D 1
A 0
A 1
A 2
A 3
B 0
B 1
B 2
B 3
36
REAL TIME
ELAPSED TIME
BUFFER
BIT COUNTER
CORRECTION ON COUNTER
CORRECTION OFF COUNTER
D8
D7
10

LD
A
B
C
BI
42
LD
A
B
C
D
46
LD
A
B
C
44
48
LD
A
B
C
D
LD
A
B
C
D
26
50
51
LD
A
B
C
28
10s of HOURS
1s of HOURS
10s of MINS.
1s of MINS.
10s of SECS.
1s of SECS.
32
BUZZER
24
14"
12"
10"
3
4
7

REAL TIME REGISTER

BUFFER REGISTER

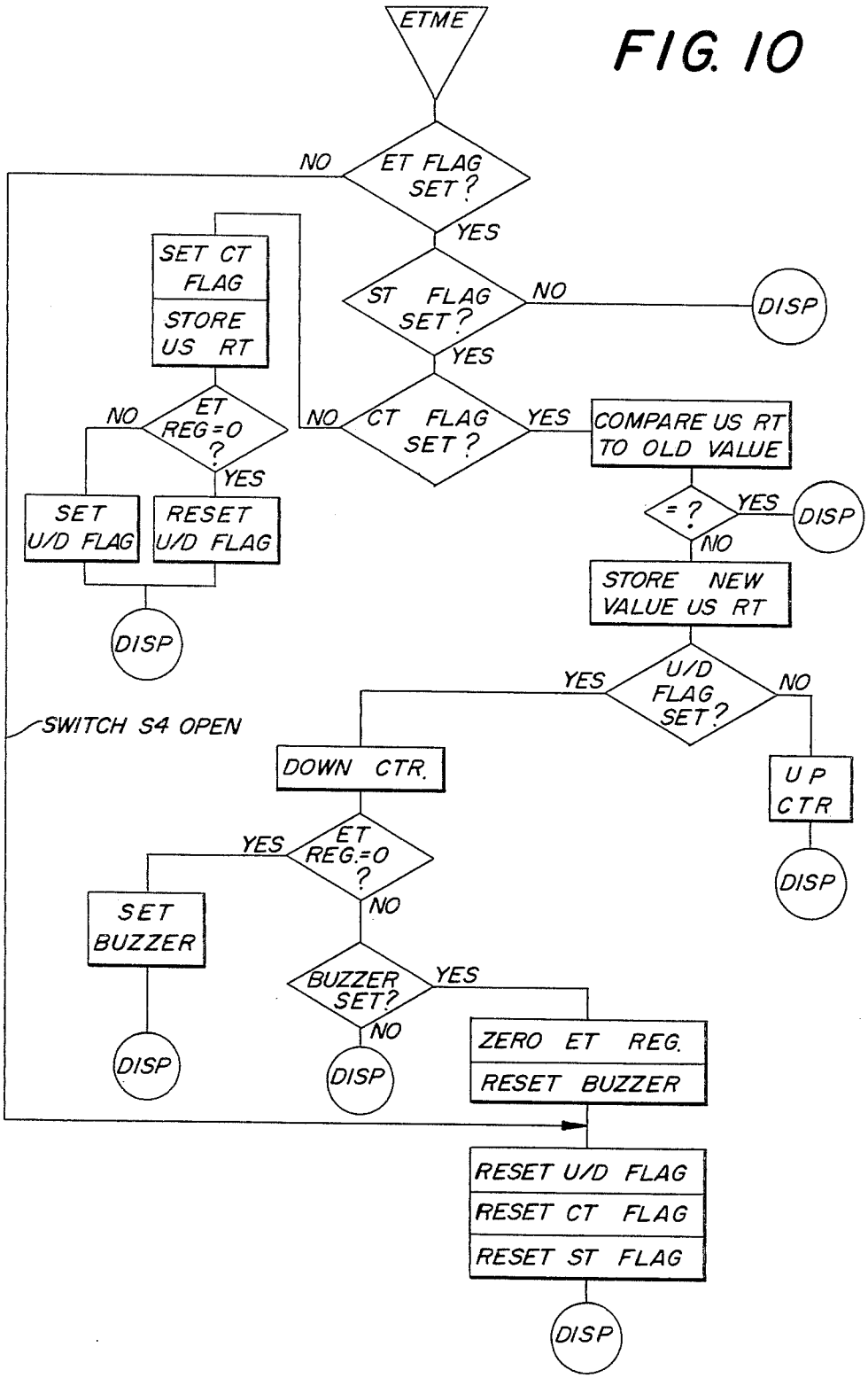
FIG. 10
ETME
ET FLAG SET ?
NO
YES
ST FLAG SET ?
NO
DISP
YES
CT FLAG SET ?
NO
YES
COMPARE US RT TO OLD VALUE
= ?
YES
DISP
NO
STORE NEW VALUE US RT
U/D FLAG SET ?
YES
NO
DOWN CTR.
UP CTR
DISP
ET REG.=0 ?
YES
NO
SET BUZZER
DISP
BUZZER SET?
YES
NO
DISP
ZERO ET REG.
RESET BUZZER
SET CT FLAG
STORE US RT
ET REG=0 ?
NO
YES
SET U/D FLAG
RESET U/D FLAG
DISP
SWITCH S4 OPEN
RESET U/D FLAG
RESET CT FLAG
RESET ST FLAG
DISP

PROGRAMMED DIGITAL SECONDARY CLOCK

BACKGROUND OF THE INVENTION

The invention is directed to a programmed digital secondary clock. In particular, the invention is directed to a programmed digital microcomputer which functions either as a master clock, a sub-master clock, or a slave clock. Identical units can be remotely located and connected in daisy chain to provide a continuously updated real time count at remote locations such as in an airport, hospital, school, bank, hotel or government or industrial facility. Real time and corrected time are displayed numerically on a digital liquid crystal display. Each unit in the daisy chain is capable of operating in any of the foregoing modes. In any of the foregoing modes, the unit can be operated as an elapsed timer or as an interval timer. When operated as a slave clock in a chain of clocks, the clock can detect malfunction of a prior unit and automatically assume the function of a master clock to ensure continued operation of the following clocks in the chain.

Heretofore, electronic secondary clocks were not capable of selective operation as either master, sub-master or slave clocks. Moreover, conventional secondary clocks were not able to display corrected time without inordinate delays. In addition, the secondary clocks could not be connected in daisy chain to continuously provide real time counts without danger of failure of the entire chain upon malfunction of a single unit.

An advantage of the invention is that the programmed secondary clock can be selectively operated either as a master, sub-master or slave clock.

Another advantage of the invention is that corrected time information can be instantly displayed.

A further advantage of the invention is that identical units can be connected in daisy chain to provide a reliable indication of real time and corrected time at remote locations regardless of malfunction of any individual unit.

A still further advantage of the invention is that each unit can be operated as an elapsed timer or as an interval timer without affecting operation of the unit as a master, sub-master or slave clock except for temporary preemption of the display.

Other advantages appear hereinafter.

BRIEF SUMMARY OF THE INVENTION

A programmed digital secondary clock which can function as a master clock, a sub-master clock or a slave clock. A real time counting means is adapted for selective connection to a reference frequency line carrying a reference frequency signal. The signal may be a 50 hz or 60 hz ac signal or a 50 hz or 60 hz digital pulse train. The real time counting means maintains an updated count of real time based on the reference frequency signal. A serial data transmitting means is adapted for connection to a slave secondary clock. Once each second, the serial data transmitting means transmits the updated real time count maintained by the real time counting means in serial data format to the slave secondary clock. The real time count is transmitted at the rate of the reference frequency. A correction means is adapted for selective connection to a conventional master clock or to a conventional electronic receiver to operate the secondary clock as a sub-master clock. The correction means periodically corrects the real time count maintained by the real time counting means in response to a correction signal produced by the master clock or by the electronic receiver. In operation of the secondary clock as a slave clock, a serial data receiving means is adapted to receive a real time count in serial data format from a master clock or a sub-master clock. The real time count maintained by the real time counting means is updated each second to the real time count received from the master clock or the sub-master clock. A display means numerically displays the updated and corrected real time count maintained by the real time counting means.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 10 is a flow chart of the ETME routine.

DETAILED DESCRIPTION OF THE INVENTION

Figure 1A:
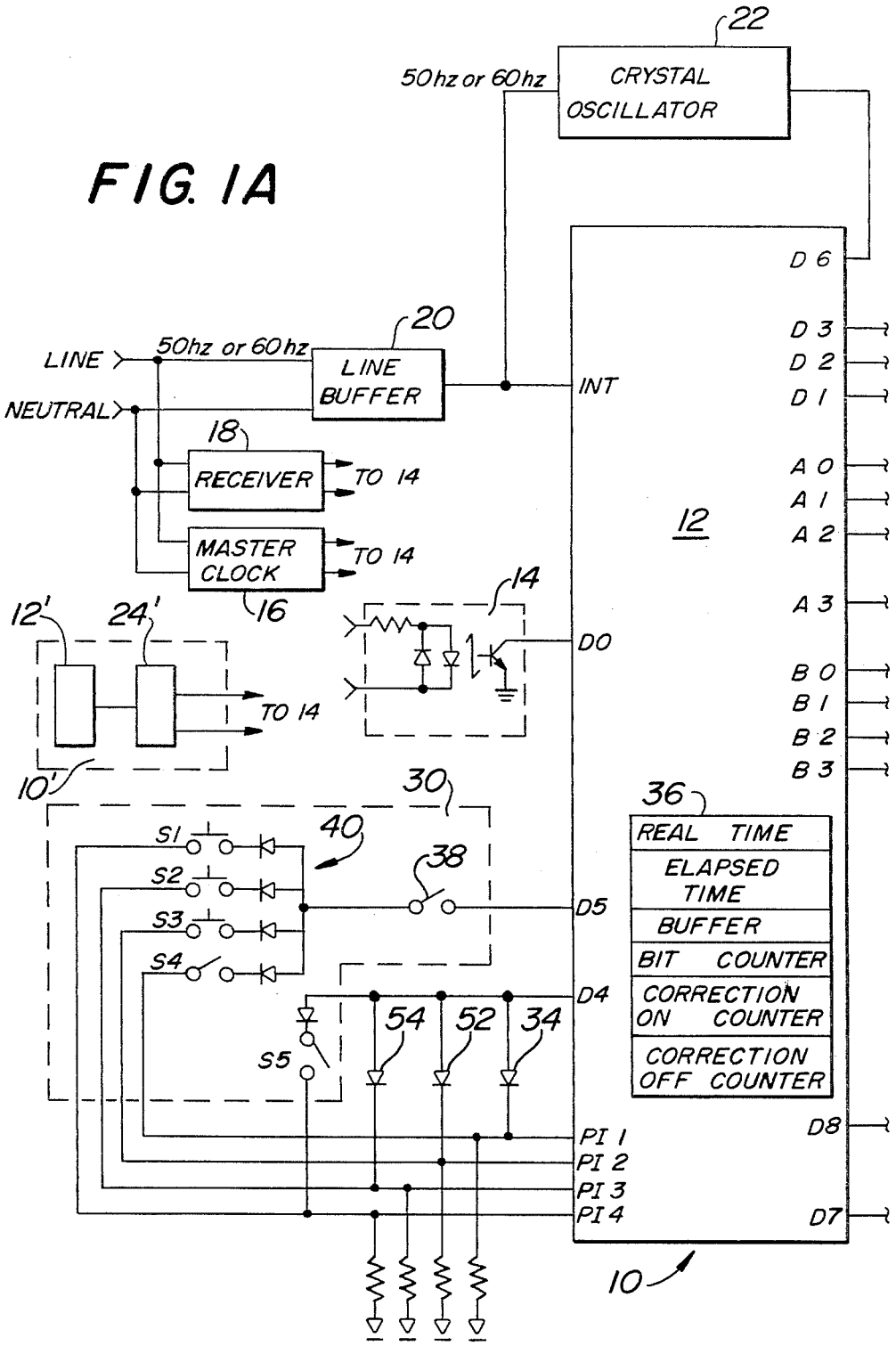
FIGS. 1A and 1B are block diagrams of the programmed digital secondary clock of the present invention.
Figure 1B:
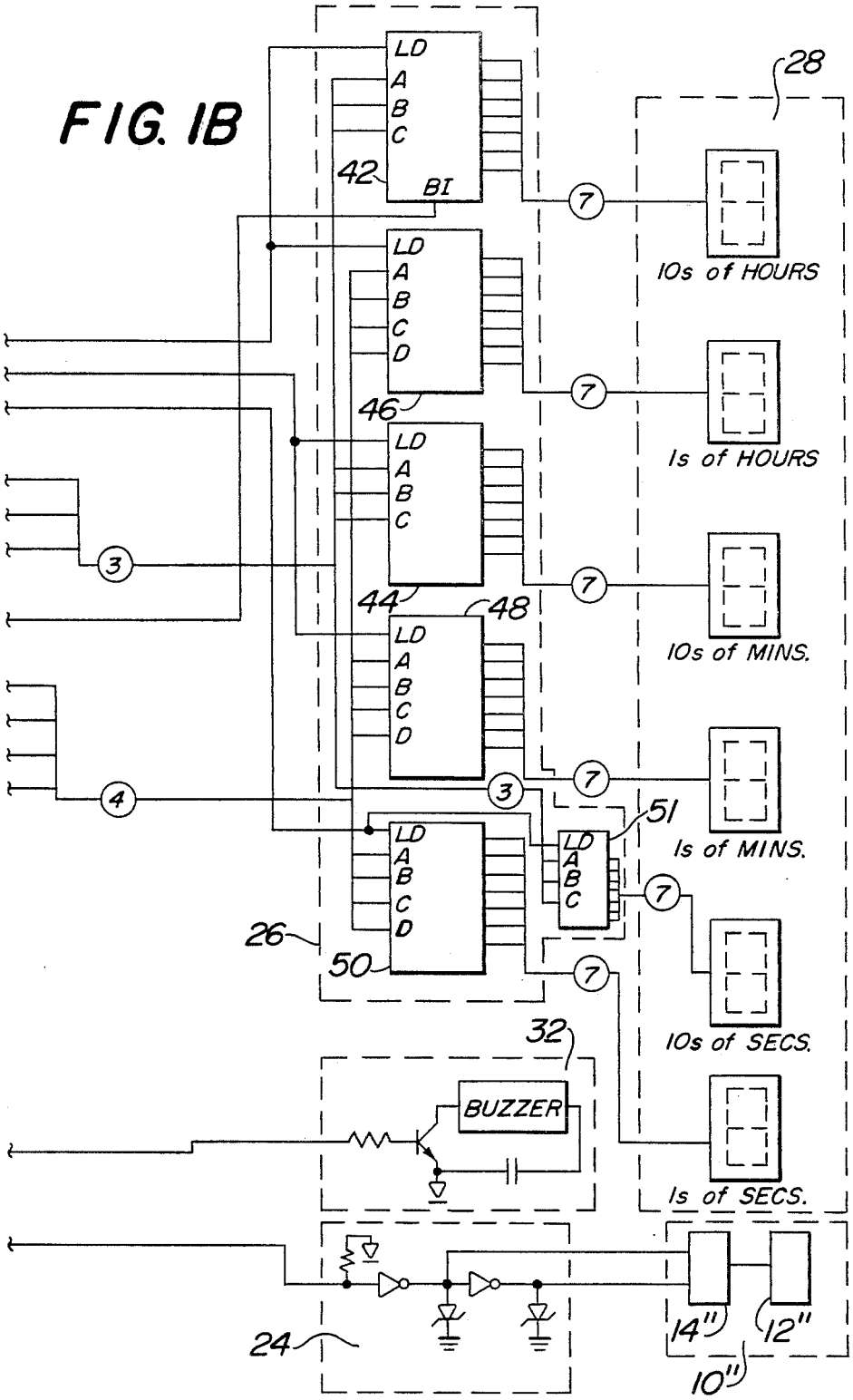

Referring to the drawings in detail, wherein like numerals indicate like elements, there is shown in FIGS. 1A and 1B a programmed digital secondary clock 10 in accordance with the present invention.

A microcomputer 12, such as the Rockwell PPS-4/1 MM 75 system microcomputer, has a discrete input port D0 which is connected to a correction buffer 14. The correction buffer 14 may be connected to a conventional electronic master clock 16 such as the Simplex 943 series master clock. The master clock 16 delivers a 115 volt correction signal either hourly or every 12 hours for purposes of correcting a conventional secondary clock unit. The correction signal delivered on the hour is an 8 second signal. The correction signal delivered every 12 hours is a 14 second signal. The correction signal generated by master clock 16 is rectified and shifted in voltage level by correction buffer 14 so that a digital pulse appears at the input port D0 during the 8 second or the 14 second correction interval. The correction buffer 14 is connected to the master clock 16 only when it is desired to operate the programmed digital secondary clock 10 as a sub-master clock as will be described hereinafter.

The correction buffer 14 is also adapted for connection to a conventional electronic receiver 18 which detects a 3510 hz (or other frequency) correction signal superimposed on the line voltage either hourly or every 12 hours. The correction buffer 14 rectifies and shifts the voltage level of the detected correction signal produced by the electronic receiver 18. The electronic receiver 18 is connected to correction buffer 14 only when it is desired to operate the programmed digital secondary clock 10 as a sub-master clock.

The microcomputer 12 is provided with a conditional interrupt input INT which is connected to a line buffer 20. The line buffer 20 is identical to correction buffer 14. Normally, when the programmed digital secondary clock 10 is operated as a master clock or as a sub-master clock, the line buffer 20 is connected to the 50 hz or 60 hz line and rectifies and shifts the voltage level of the 115 volt 50 hz or 60 hz line voltage so that a 50 hz or 60 hz train of digital pulses appears at the INT input. The 50 hz or 60 hz signal appearing at the INT input is used to maintain an updated count of real time as described in detail hereinafter.

The INT input of microcomputer 12 may also be connected to the output of a crystal oscillator 22. The crystal oscillator 22 may be a RCA CD4060A counter connected in conventional manner to a crystal for providing a 50 hz or 60 hz pulse train output. The crystal oscillator 22 is synchronized by the D6 output port of microcomputer 12 when the programmed digital secondary clock 10 is operated as a slave clock as described in detail hereinafter. In addition, crystal oscillator 22 may be disconnected from the D6 port and connected directly to the INT port, and buffer 20 may be disconnected from the line, so that the crystal oscillator 22 replaces the line as the source of the 50 hz or 60 hz signal when clock 10 is operated as a master clock or as a sub-master clock.

The correction buffer 14 may be disconnected from master clock 16 or receiver 18 and connected to the output of a serial driver 24' associated with the microcomputer 12' of a programmed digital clock 10' which is operated as a master or a sub-master clock. This connection is employed when the programmed digital clock 10 is used as a slave clock as will be described more fully hereinafter.

The microcomputer 12 has a discrete output port D7 connected to a serial driver 24. The serial driver 24 transmits real time information generated at the port D7 to a following clock 10'' which is operated as a slave clock. The output of the serial driver 24 provides real time information to the slave clock 10'' when the programmed digital secondary clock 10 is operated either as a master clock, as a sub-master clock or as a slave clock.

Real time information is also transmitted by the microcomputer 12 via parallel output ports A0–A2 and B0–B3 to a bank 26 of 7-segment latch/decoder/drivers. The latch/decoder/drivers may be LSI Computer Systems, Inc. LS7100 latch/decoder/drivers. The outputs of bank 26 drive a 7-segment liquid crystal display 28. The liquid crystal display 28 numerically displays the real time information maintained by the microcomputer 12 either in tens and units of hours and tens and units of minutes or in tens of units of minutes and tens and units of seconds. Thus, updated and/or corrected real time information is displayed instantly by the liquid crystal display 28 whether the programmed digital second clock 10 is operated as a master clock, sub-master clock or slave clock.

The programmed digital secondary clock 10 may also be operated as an elapsed timer or as an interval timer by selective manipulation of a bank of switches S1–S5 provided on a keyboard 30 connected between discrete output ports D4 and D5 and parallel input ports PI1–PI4. When the programmed digital secondary clock 10 is operated as an elapsed timer, microcomputer 12 resets the display 28 to zero and then increments the display 28 every second to display the elapsed time count. The elapsed time count may be interrupted and resumed by successive operation of switch S3 on keyboard 30.

When the programmed digital secondary clock 10 is operated as an interval timer, the microcomputer 12 presets the display 28 to a preselected time in response to selective actuation of switches S1 and S2 on keyboard 30. The microcomputer 12 then decrements the display every second to display the interval time count. The interval time count may be interrupted and resumed by successive operation of switch S3 or the interval time count may continue without interruption until zero time is displayed. If the display 28 is decremented to zero time, the microcomputer 12 actuates a transistor driven buzzer 32 via the discrete output port D8 to indicate the end of the interval. Operation of clock 10 as an elapsed timer or as an interval timer does not affect the operation of the clock 10 as a master clock, sub-master clock or slave clock except for temporary preemption of the display 28.

Operation As Master Clock

Figure 11A:
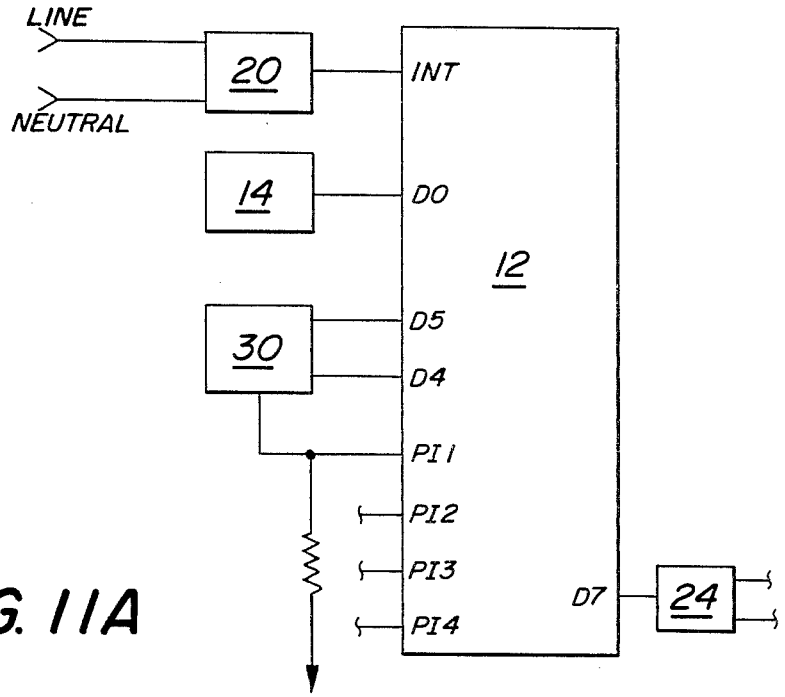
FIG. 11A shows one embodiment of the programmed digital secondary clock as a master clock.
Figure 11B:
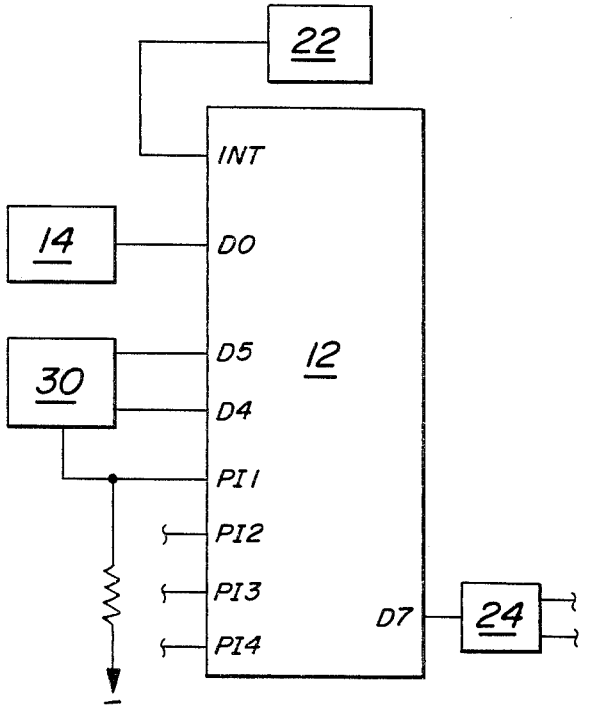
FIG. 11B shows another embodiment of the programmed digital secondary clock as a master clock.

To operate the programmed digital secondary clock 10 as a master clock, a diode 34 is not connected across the discrete output port D4 and the parallel input port PI1 of the microcomputer 12. See FIG. 11A. The line buffer 20 may be connected to the INT input of microcomputer 12 if it is desired to maintain a real time count based on the line signal. Alternatively, the real time count may be maintained by the clock 10 in response to the crystal oscillator 22 signal. See FIG. 11B. When diode 34 is not connected across ports D4 and PI1, microcomputer 12 permits the oscillator 22 to freerun. The input to the correction buffer 14 is open, i.e., not connected to master clock 16 or receiver 18, when clock 10 is operated as a master clock.

Figure 2:
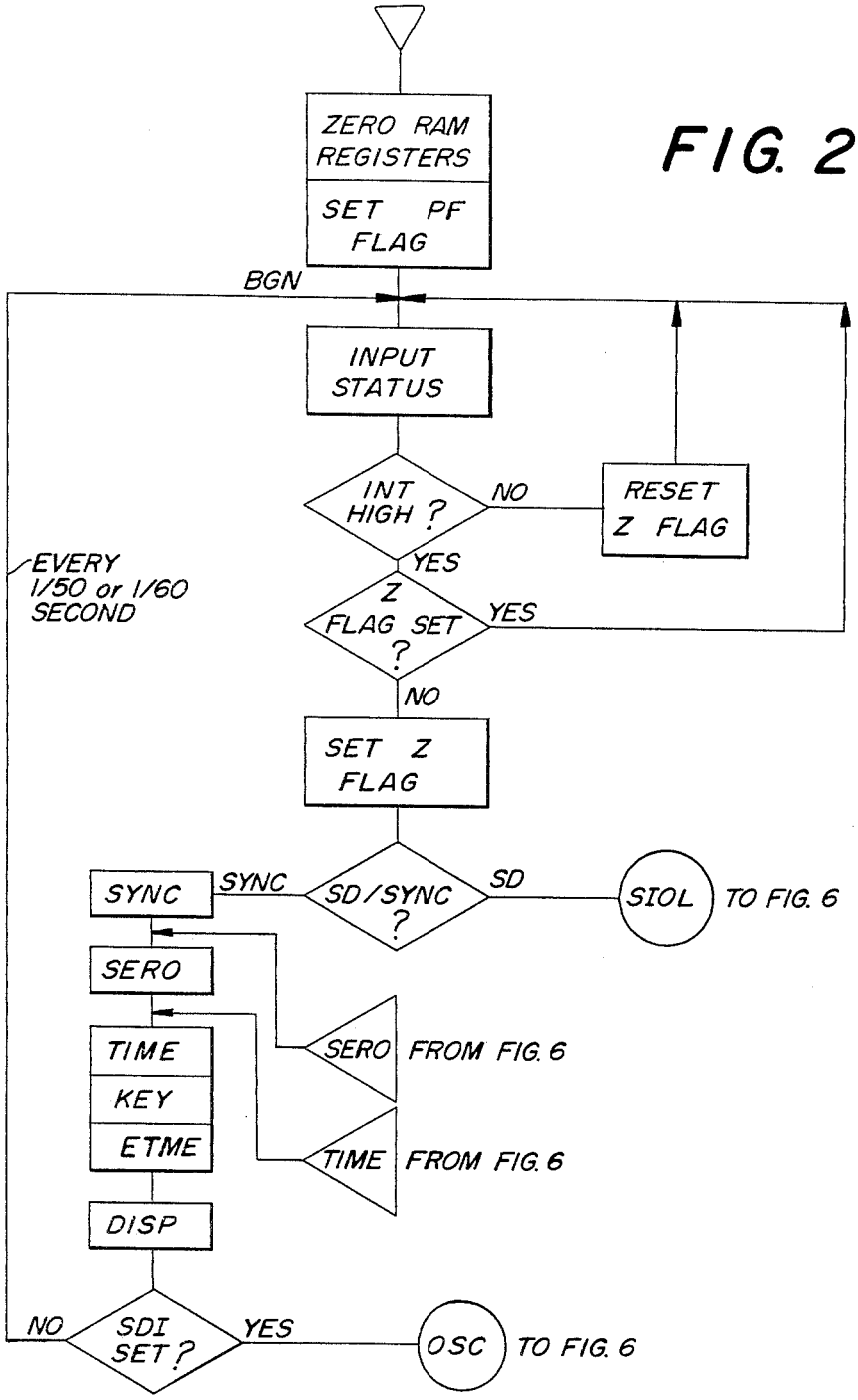
FIG. 2 is a flow chart of the program executed by the digital secondary clock shown in FIGS. 1A and 1B.
Figure 3:
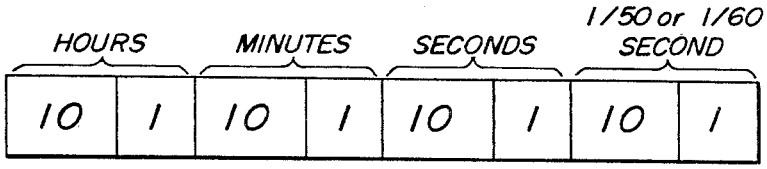
FIG. 3 is a diagram of the real time register.
Figure 4:
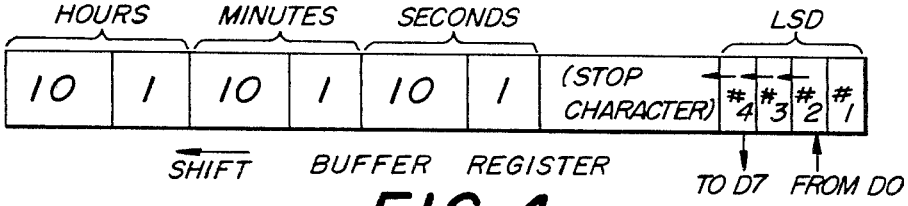
FIG. 4 is a diagram of the buffer register.

Referring to FIGS. 1A and 1B and 2, the microcomputer 12 first zeroes the RAM registers 36 in microcomputer 12. RAM registers 36 include a real time register, an elapsed time register and a buffer register. After the RAM registers are zeroed, the microcomputer 12 sets a power failure (PF) flag and enters the BGN point. As described more fully below, the microcomputer 12 will return to the BGN point and cycle through the TIME routine every 1/50 second (if a 50 hz INT signal is used) or every 1/60 second (if a 60 Hz INT signal is used). The microcomputer 12 then checks the status of the input ports (INPUT STATUS). In particular, the microcomputer 12 determines whether the diode 34 has been connected between the ports D4 and PI1 by pulsing port D4 and inspecting port PI1 for a return pulse.

If a return pulse is not detected at the PI1 port, this indicates that the diode 34 is not connected between ports D4 and PI1 and that the clock 10 is to be operated either as a master clock or as a sub-master clock. Since correction buffer 14 is not connected to master clock 16 or receiver 18, clock 10 will operate as a master clock.

The microcomputer 12 then determines whether the signal at the INT port is high or low (INT HIGH?). In the preferred embodiment herein, the real time count is maintained in response to positive or low to high signal transitions at the INT port. If the signal at the INT port is low, the microcomputer 12 resets a Z flag (RESET Z FLAG) and again checks the status of the INT port. The Z flag is used to ensure that the microcomputer 12 will respond to positive transitions at the INT port but not to absolute signal levels. Thus, if the microcomputer 12 detects a high signal at the INT port, the microcomputer checks whether the Z flag has been reset (Z FLAG SET?). The Z flag is reset only if the INT port signal was previously low. If the Z flag has not been reset, the microcomputer 12 ignores the high signal at the INT port and loops back to the INPUT STATUS block.

When a positive transition at the INT port is sensed and the Z flag has been reset, the microcomputer sets the Z flag (SET Z FLAG) and determines whether the programmed digital clock 10 is to be operated in the synchronous (SYNC) mode or in the serial data (SD) mode. When operated in the SD mode, the clock 10 functions as a slave clock. When operated in the SYNC mode, the clock 10 operates either as a master clock or as a sub-master clock. If diode 34 is not connected between port D4 and PI1, the microcomputer determines that clock 10 is to function as a master clock or as a sub-master clock and that operation is to proceed in the SYNC mode.

Figure 5:
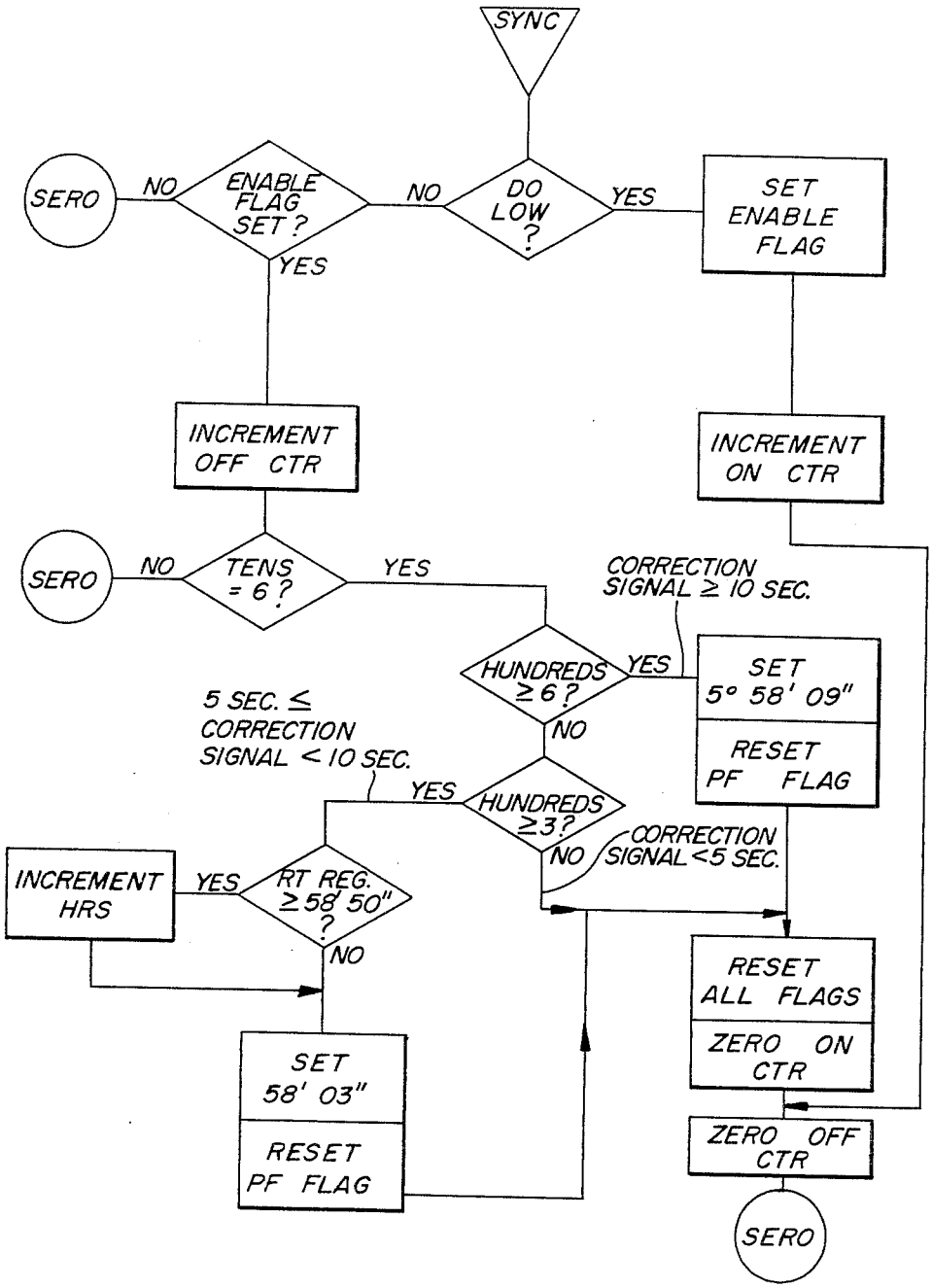
FIG. 5 is a flow chart of the SYNC routine for correcting the real time count when the count is operated as a sub-master clock.

In the SYNC mode, the microcomputer 12 enters the SYNC routine. In the SYNC routine, the microcomputer 12 checks the discrete input port D0 to determine whether a correction signal is present at the input of correction buffer 14 (D0 LOW?). See FIG. 5. For operation as a master clock, the input of the correction buffer 14 is open. Accordingly, no correction signal will be received at the D0 port, and the microcomputer 12 will exit the SYNC routine at the ENABLE FLAG SET? block and enter the serial out (SERO) subroutine.

Figure 7:
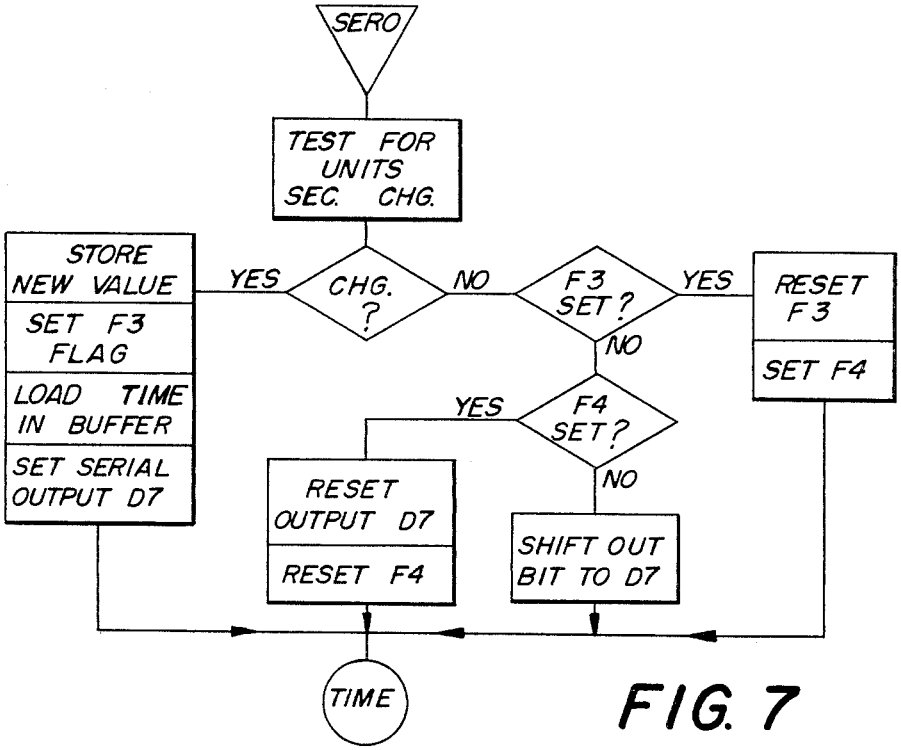
FIG. 7 is a flow chart of the SERO routine for transmitting serial digital information when the clock is operated as a master clock or as a sub-master clock.

In the SERO routine, the microcomputer 12 checks the status of the real time register in RAM 36 (TEST FOR UNITS SEC CHG) and determines whether a change has occurred in the units of seconds portion of the real time register (CHG?). See FIG. 7. If no change has occurred in the units of seconds portion of the real time register, the microcomputer 12 determines whether a pair of flags F3 and F4 have been set (F3 SET? and F4 SET?). The F3 and F4 flags are used to generate a start character at the D7 output port as described hereinafter. The start character is a 3 bit character whose first 2 bits are binary "1"s and whose third bit is a binary "0".

The F3 and F4 flags are not set unless a change has been detected in the units of seconds portion of the real time register. If flags F3 and F4 have not been set, the microcomputer shifts out a bit of real time data from the buffer register in RAM 36 to the output port D7 (SHIFT OUT BIT TO D7). The buffer register is loaded with the contents of the real time register whenever the units of seconds portion of the real time register is incremented one count, i.e., once each second. In between changes in the units of seconds portion of the real time register, a bit of data is shifted out of the buffer register to port D7 every 1/50 second (if a 50 hz signal is used at the INT port) or every 1/60 second (if a 60 hz signal is used at the INT port). Thus, the buffer register data is serially shifted out to port D7 at the 50 hz or 60 hz rate.

Figure 8:
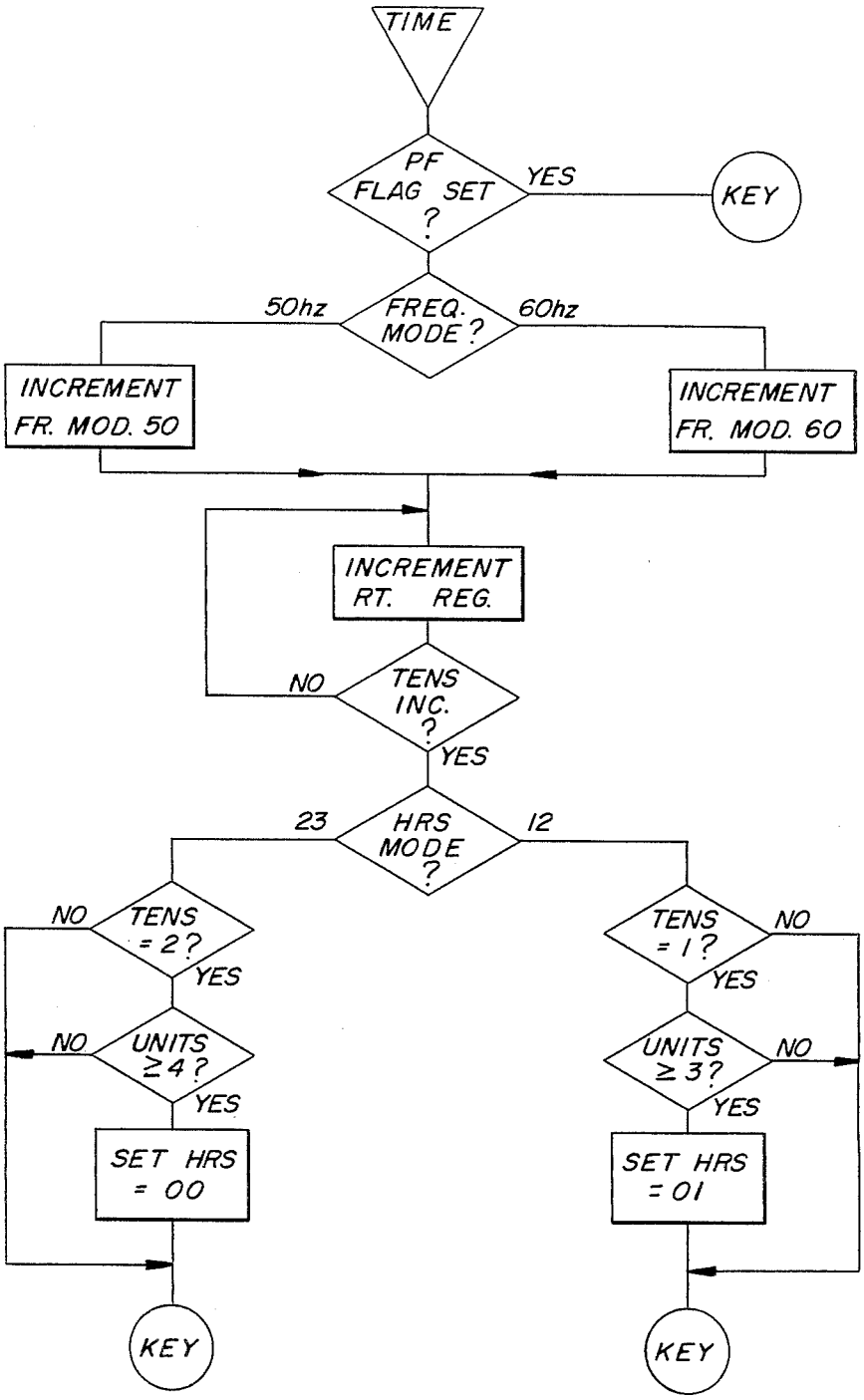
FIG. 8 is a flow chart of the TIME routine for updating the real time count.

If a change is detected in the units of seconds portion of the real time register, the microcomputer stores the new units of seconds value (STORE NEW VALUE), sets the F3 flag (SET F3 FLAG), loads the buffer register with the updated contents of the real time register (LOAD TIME IN BUFFER) and sets the port D7 (SET SERIAL OUTPUT D7) to generate the first bit of the start character at the port. The start character is described more particularly hereinafter in connection with operation of clock 10 as a slave clock. The microcomputer 12 then enters the TIME routine. See FIG. 8.

In the TIME routine, the microcomputer 12 updates the real time register by incrementing the units of fractions of seconds portion of the real time register (INCREMENT RT REG) in response to the 50 hz or 60 hz signal appearing at the INT input port. If the INT signal is a 50 hz signal, the units of fractions seconds portion of the real time register will count every 1/50 second. If the INT signal is a 60 hz signal, the units of fractions seconds portion will count every 1/60 second. Operation of microcomputer 12 in the TIME routine is described in greater detail hereinafter in connection with the selection of the frequency base (50 hz or 60 hz) and the hourly display format. After the units of fractions seconds of the real time register is incremented one count in response to the signal at the INT port, the microcomputer 12 enters the KEY routine. See FIG. 9.

In the KEY routine, the microcomputer 12 samples the bank of switches on keyboard 30 (INPUT & STORE SWITCHES). The D5 output port of the microcomputer 12 is connected via a key switch 38 to a bank of diodes 40. See FIG. 1A. The key switch 38 is closed whenever the programmed digital secondary clock 10 is operating. Microcomputer 12 checks the status of switches S1–S5 via the parallel input ports PI1, PI2, PI3 and PI4. The status of the switches is stored in RAM 36 for use in operation of the clock 10 as an elapsed timer or as an interval timer and for determining whether either hours and minutes or minutes and seconds are to be displayed on display 28. If switch S4 is not closed, clock 10 cannot be operated as an elapsed timer or as an interval timer. Assuming that the switch S4 is open, the microcomputer 12 branches at the elapsed time/real time (ET/RT) block to reset the PF flag (RESET PF FLAG), select hours and minutes or minutes and seconds for display (HRS?) and enter the elapsed time routine (ETME). See FIG. 10. Operation of the microcomputer 12 in the KEY and ETME routines is described in greater detail hereinafter in connection with elapsed timer and interval timer operation.

Assuming that the switch S4 is not closed, the microcomputer 12 jumps from ET FLAG SET? block in the ETME routine to the display routine (DISP) after resetting flags U/D, CT and ST. See FIG. 10. The U/D, CT and ST flags are described hereinafter in connection with elapsed timer and interval timer operation.

In the DISP routine, the A0, A1 and A2 output ports drive the tens of hours decoder/driver 42, the tens of minutes decoder/driver 44 and the tens of seconds decoder/driver 51. See FIG. 1B. The tens of hours, tens of minutes and tens of seconds real time information provided at the A0, A1 and A2 outputs is loaded into the decoder/drivers 42, 44 and 51 under control of the discrete output ports D3, D2 and D1.

Real time information as to the units of hours, units of minutes and units of seconds is provided at the parallel outputs B0, B1, B2 and B3 of microcomputer 12. The B0–B3 output ports drive the units of hours decoder/-driver 46, the units of minutes decoder/driver 48 and the units of seconds decoder/driver 50. The units of hours decoder/driver 46 and the units of minutes decoder/driver 48 are controlled by the D3 and D2 output ports. The units of seconds decoder/driver 50 is controlled by the D1 output port.

The D3 and D2 output ports are sequentially pulsed by microcomputer 12. The digital information set up on the A0–A3 and B0–B3 output ports is shifted between hours/minutes and minutes/seconds in coincidence with the D3 and D2 outputs. The D1 output may be used for continuous operation of the six digits of display 28 or for generating a flashing colon. The determination as to whether hours and minutes or minutes and seconds are to be displayed is made based upon the status of switch S5 which is inspected at the PI4 input port. When the switch S5 is open, display 28 displays hours and minutes under control of microcomputer 12. On the other hand, when the switch S5 is closed, the display 28 displays minutes and seconds under control of the microcomputer 12.

The microcomputer 12 then determines whether a serial data in (SDI) flag has been set (SDI SET?). See FIG. 2. In operation of the clock 10 as a master clock the SDI flag is not set. Accordingly, the microcomputer 12 loops back to the BGN point in the program and repeats the foregoing cycle of operations. The microcomputer 12 cycles through the program 50 times per second (50 hz signal at INT port) or 60 times per second (60 hz signal at INT port). During each loop, the microcomputer cycles through the SERO routine. See FIG. 7. In the 1/50 second or 1/60 second immediately following the interval during which the buffer register was loaded with real time data, the microcomputer determines that the F3 flag was set (F3 SET?), resets the F3 flag (RESET F3), sets the F4 flag (SET F4) and enters the TIME routine. The D7 port remains set. This represents the second bit of the start character. The D7 port is not reset until the microcomputer loops back to the SERO routine in the next 1/50 second or 1/60 second. At that time, the microcomputer determines that the F3 flag is not set but that the F4 flag is set. Accordingly, the microcomputer resets the D7 port (RESET OUTPUT D7). This represents the third bit of the start character. The microcomputer then resets the F4 flag (RESET F4) and enters the TIME routine. Thus, after three cycles (three passes through the SERO routine), a start character [110] is generated at the D7 port. Thereafter, during each loop through the program in FIG. 2, the real time register count is displayed on display 28 and the real time data is serially shifted out of the buffer register to port D7.

All of the foregoing operations are repeated whenever a units of seconds change is detected in the real time register.

Operation as Sub-Master Clock

In operation of the programmed digital secondary clock 10 as a sub-master clock, the microcomputer 12 zeroes the RAM registers, sets the PF flag and enters the BGN point. See FIG. 2. The microcomputer then checks the input ports (INPUT STATUS) and sets the Z flag. The microcomputer then determines whether the clock is to operate in the SYNC mode (operation as master clock or sub-master clock) or the SD mode (operation as slave clock only) by inspecting port PI1 as previously described. When operating as a sub-master clock, the microcomputer 12 branches to the SYNC mode from the SD/SYNC block, and the microcomputer 12 enters the SYNC routine. See FIG. 5.

Figure 12A:
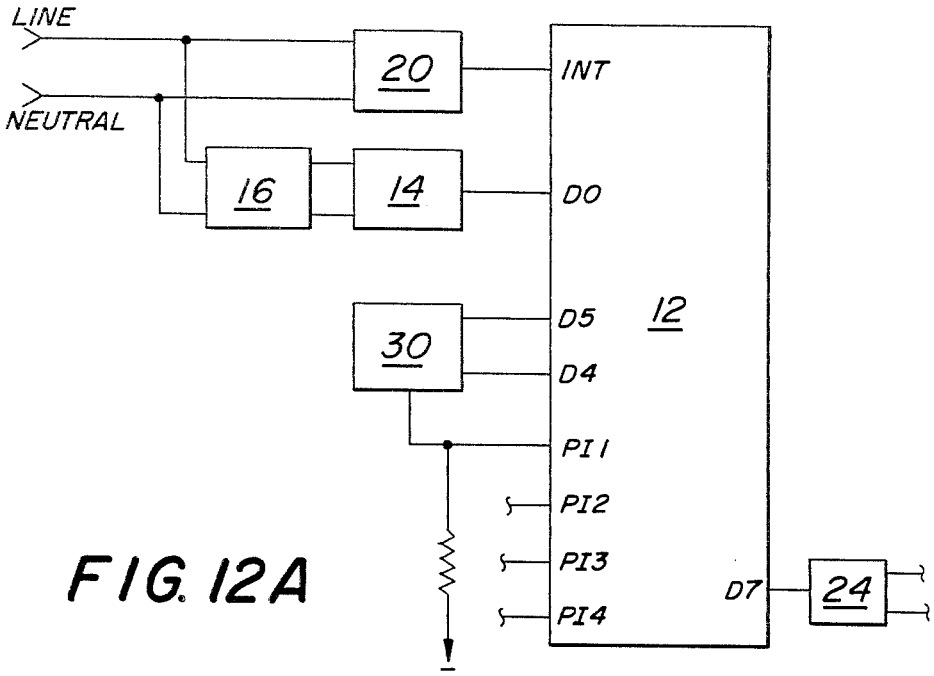
FIG. 12A shows one embodiment of the programmed digital secondary clock as a sub-master clock.
Figure 12B:
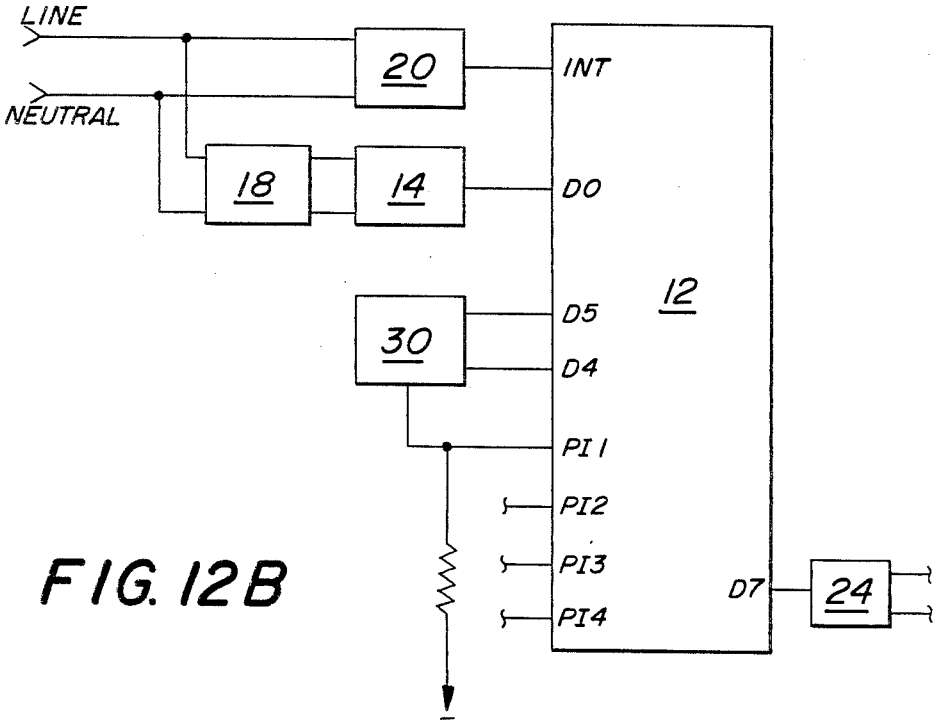
FIG. 12B shows another embodiment of the programmed digital secondary clock as a sub-master clock.

In the SYNC routine, the microcomputer 12 corrects the real time register count. The microcomputer first checks the D0 input port. When the clock 10 is operated as a sub-master clock, either the electronic receiver 18 or the master clock 16 is connected to the correction buffer 14 as previously described. See FIGS. 12A and 12B. Accordingly, a correction signal will appear at port D0.

The microcomputer 12 detects a negative or high to low transition of the correction signal at input port D0 (D0 LOW?). See FIG. 5. The negative transition marks the start or the leading edge of the correction signal. If a negative transition is detected at port D0, the microcomputer 12 sets an ENABLE flag (SET ENABLE FLAG) and increments a Correction On Counter in RAM 36 (INCREMENT ON CTR). The microcomputer then zeroes a Correction Off Counter in RAM 36 (ZERO OFF CTR) and enters the SERO routine. As previously described, in the SERO routine, the microcomputer checks for a change in the units of seconds portion of the real time register, serially shifts data out of the buffer register to port D7, and loads the buffer register with the updated real time register count if a units of seconds change is detected. The microcomputer then cycles through the TIME, KEY, ETME and DISP routines as previously described in connection with operation of clock 10 as a master clock. The SYNC routine is therefore entered, and the Correction On Counter incremented, every 1/50 second (50 hz INT signal) or every 1/60 second (60 hz INT signal).

If the correction signal at port D0 is an hourly correction signal, it will remain low nominally for 8 seconds, i.e., from 57 minutes, 54 seconds to 58 minutes, 2 seconds (in terms of master clock or electronic receiver time). Actually, the hourly correction signal may remain low for 5–10 seconds. After the nominal 8 second interval, the correction signal will undergo a positive or low to high transition. The positive transition marks the end or the trailing edge of the correction signal. At this point, the microcomputer 12 detects the positive transition (D0 LOW?), confirms that the ENABLE FLAG had previously been set on detection of the negative transition of the correction signal (ENABLE FLAG SET?), and increments a Correction Off Counter in RAM 36 (INCREMENT OFF CTR). Thereafter, the SYNC routine is entered and the Correction Off Counter is incremented every 1/50 second (50 hz INT signal) or every 1/60 second (60 hz signal) while the correction signal is off or high.

When the tens portion of the Correction Off Counter indicates that 1 second has elapsed since the positive transition in the the correction signal (TENS=6?), the microcomputer 12 inspects the hundreds portion of the Correction On Counter to determine whether the correction signal was an hourly signal, i.e., low for 5 or more seconds but less than 10 seconds (HUNDREDS≧6? and HUNDREDS≧3?). If the correction signal is an hourly signal, the microcomputer sets the minutes and seconds portions of the real time register to 58 minutes, 3 seconds (SET 58′ 03″). The hours portion of the real time register is not corrected unless the real time register count is slow by more than 58′ 03″ but less than 59′ 13″. The microcomputer determines whether the real time register count is slow within the foregoing range (RT REG≧58′ 50″) and, if so, corrects the hours portion of the real time register one count (INCREMENT HRS) immediately prior to correcting the minutes and seconds portion of the register to 58′ 03″.

The microcomputer then resets the PF flag (RESET PF FLAG), resets all other flags (RESET ALL FLAGS), and zeroes the Correction On Counter (ZERO ON CTR) in preparation for the next correction signal. The microcomputer then enters the SERO routine.

If the correction signal appears at the input D0 every 12 hours, instead of hourly, the microcomputer will detect a negative transition at the D0 port at 5 hours, 57 minutes, 54 seconds (in terms of the electronic receiver or the master clock time). This is the start or leading edge of the correction signal. The correction signal will remain low nominally for 14 seconds but no less than 10 seconds. The microcomputer will increment the Correction On Counter as previously described. After the nominal 14 second interval, the correction signal will undergo a positive transition. This is the end or trailing edge of the correction signal. The positive transition will be sensed at port D0 by the microcomputer 12, and the microcomputer will increment the Correction Off Counter as previously described. When the tens portion of the Correction Off Counter counts 1 second of elapsed time since the positive transition of the correction signal, the microcomputer determines whether the correction signal was a twelve hour signal, i.e., whether the correction signal was on or low for at least 10 seconds (HUNDREDS≧6?). If the correction signal is a twelve hour signal, the microcomputer sets the hours, minutes and seconds portion of the real time register to 5 hours, 58 minutes, 9 seconds (SET 5° 58′ 09″).

The microcomputer then resets the PF flag and all other flags and zeroes the Correction On Counter in preparation for the next correction signal. The microcomputer then enters the SERO routine.

If, after the end or trailing edge of the correction signal is detected, the microcomputer determines that the hundreds portion of the Correction On Counter indicates that the correction signal was on or low for less than 5 seconds, the microcomputer disregards the correction signal. Thus, the microcomputer resets all flags, zeroes the Correction On Counter and the Correction Off Counter and enters the SERO routine without correcting the real time register count.

If a negative transition in the D0 port signal is not detected at the D0 LOW? block, this indicates that no correction signal has appeared at the D0 port. Accordingly, the microcomputer leaves the SYNC routine at the ENABLE FLAG SET? block and enters the SERO routine without correcting the real time register count. See FIG. 5. Similarly, if a positive transition in the D0 port signal is detected (marking the end of the correction signal) but the Correction Off Counter has not counted at least one second of elapsed time since the positive transition, the microcomputer branches at the TENS=6? block and exits to the SERO routine without correcting the real time register count. Thus, the real time register count is corrected only after one second has elapsed following the end of the correction signal. The one second interval is used to permit all signals to settle before the correction is effected.

The Correction On Counter and the Correction Off Counter are incremented as indicated above at a 50 hz (50 hz INT signal) or at a 60 hz rate (60 hz INT signal). Each time that the correction counters are incremented, i.e., each 1/50 or 1/60 second, the microcomputer proceeds to the SERO routine. See FIG. 7.

In the SERO routine, the microcomputer determines whether the units of seconds portion of the real time register in RAM 36 has changed. If a change has occurred in the units of seconds portion of the real time register, the real time count maintained in the register is loaded into the buffer register in RAM 36 and the first start bit of the character is set up at port D7 as previously described. The microcomputer then enters the TIME routine and loops through the program to generate the second and third bits of the start character as previously described.

If the microcomputer detects no change in the units of seconds portion of the real time register, the microcomputer causes one bit to be serially shifted out of the buffer register to output port D7. The microcomputer then enters the TIME routine to update the real time register count in response to the 50 hz or 60 hz signal at the INT port. In the TIME routine, the microcomputer increments the units of fractions of seconds portion of the real time register in response to the 50 hz or 60 hz signal at the INT port. The microcomputer then loops back to the BGN point in the program through the KEY, ETME and DISP routines as previously described.

Each loop through the program takes place over a period of 1/50 or 1/60 second. Accordingly, corrected and updated real time information temporarily stored in the buffer register is serially shifted out at the D7 port at the 50 hz or 60 hz rate. The serial driver 24 transmits the real time information serially shifted out of the buffer register for reception by the slave clock 10″ which is connected in daisy chain to the clock 10. See FIGS. 1A and 1B.

Operation as Slave Clock

Figure 13:
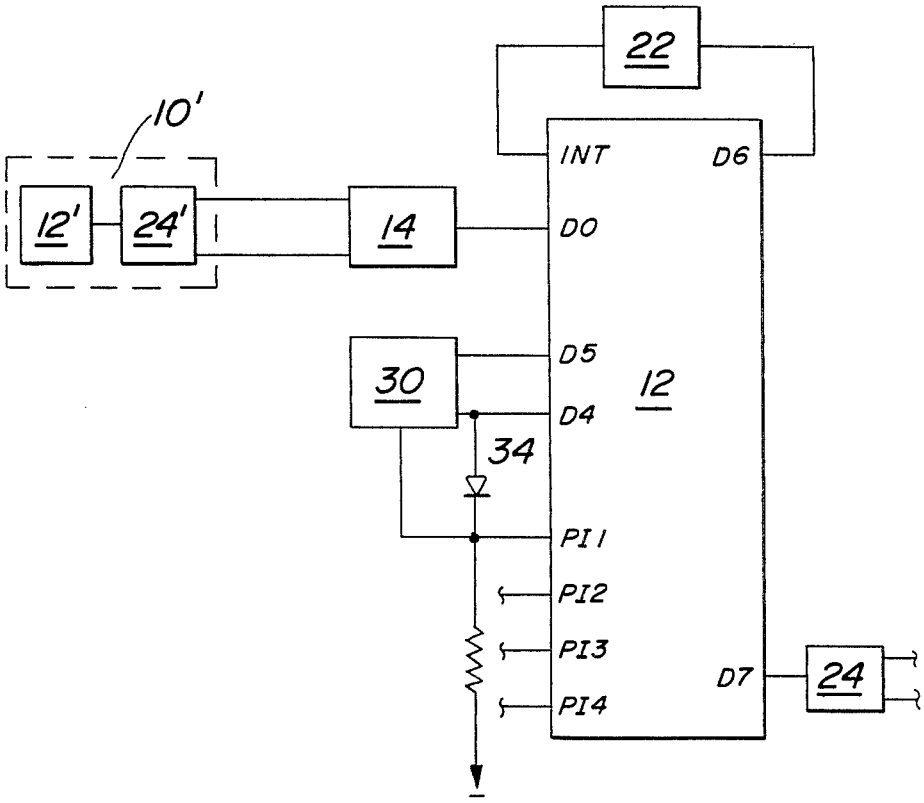
FIG. 13 shows an embodiment of the programmed digital secondary clock as a slave clock.

When the programmed digital secondary clock 10 is operated as a slave clock, the correction buffer 14 is connected to the serial driver 24′ of the clock 10′. See FIG. 13. The clock 10′ can be a master clock, sub-master clock or a slave clock. When the clock 10 is operated as a slave clock, the line buffer 20 is not connected to the INT port of microcomputer 12, and the only connection to the INT port is the connection to the crystal oscillator 22. The crystal oscillator 22 is connected to the D6 output port of the microcomputer and is used to gate in the serial real time information received from serial driver 24′ at the input port D0 via correction buffer 14.

Figure 6:
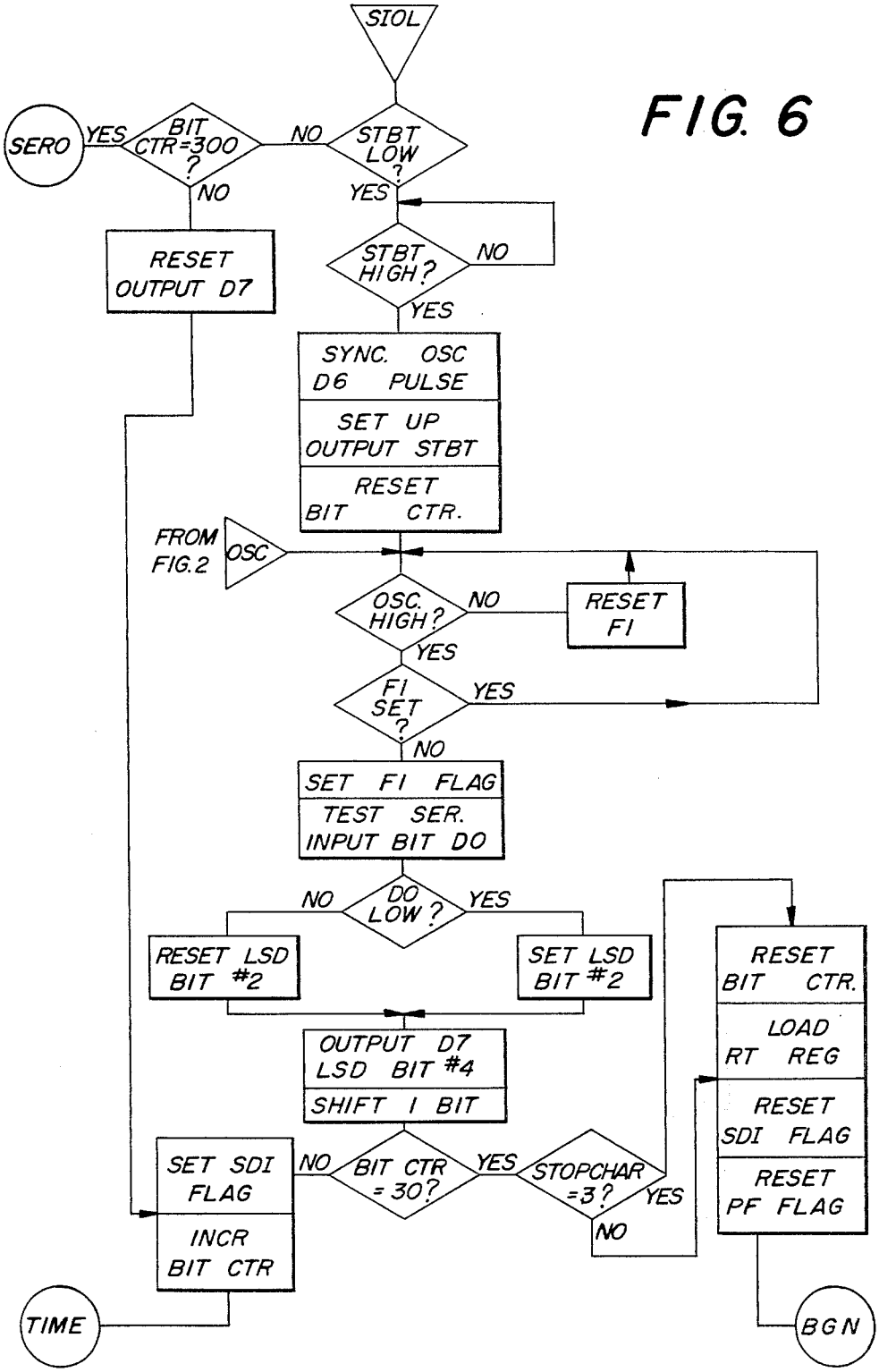
FIG. 6 is a flow chart of the SIOL routine for receiving and transmitting serial digital information when the clock is operated as a slave clock.

Referring to FIG. 2, the microcomputer 12 zeroes the RAM registers, sets the PF flag, and checks the status of the input ports and sets the Z flag as previously described. The microcomputer in particular checks port PI1 (FIG. 13) for the presence of diode 34. When clock 12 is operated as a slave clock, diode 34 is connected across the ports D4 and PI1. Accordingly, when port D4 is pulsed, a return pulse is detected at port PI1. The microcomputer therefore determines that operation is to take place in the serial data or SD mode (SD/SYNC?). Accordingly, the microcomputer enters the SD branch and the serial in/out (SIOL) routine. See FIG. 6.

In the SIOL routine, the microcomputer checks the input port D0 for the third start bit from serial driver 24' (STBT LOW?). The first and second start bits transmitted by serial driver 24' comprise a 2/50 second long or 2/60 second long binary "1" generated by clock 10' in the SERO routine in the manner previously explained. The microcomputer detects the leading edge of the third start bit which is a binary "0". If the leading edge of the third start bit is detected at the D0 input port, the microcomputer generates a signal at the D6 port to reset the crystal oscillator 22 (SYNC OSC D6 PULSE). Accordingly, the pulse train output of crystal oscillator 22 will be synchronized to the serial time information being received from clock 10' at the D0 input port. The oscillator 22 is used to gate the serial time information through the microcomputer 12.

In addition, when the third start bit is detected at the D0 input port, the microcomputer 12 sets the three least significant bits of the buffer register, bits #2, #3 and #4, to a start character, i.e., [110] (SET UP OUTPUT STBT). The microcomputer 12 then resets a bit counter in RAM 36 (RESET BIT CTR). The bit counter is used to check for proper transmission of time information to port D0 via correction buffer 14 as will be described hereinafter.

After resetting the bit counter, the microcomputer checks the INT port to determine whether a gating pulse has been generated by the crystal oscillator 22 (OSC HIGH?). If a crystal oscillator pulse is not present at the INT input, the microcomputer resets a flag F1 (RESET F1) and waits until a crystal oscillator pulse appears at the INT port. Flag F1 is used to ensure a single pass through the program upon a positive signal transition at the INT port.

Upon detecting the presence of a crystal oscillator pulse at the INT input port, the microcomputer checks whether the F1 flag was set previously (F1 SET?). If so, the microcomputer waits until the INT port pulse ends and then resets the F1 flag. If the F1 flag has not previously been set, the microcomputer sets the F1 flag and checks port D0 for the presence of a data bit representative of real time information from the buffer 14 (TEST SER. INPUT BIT D0).

The microcomputer then determines whether the data bit on port D0 is low or high (D0 LOW?) and primes bit #2 of the buffer register to receive the detected data bit (RESET LSD BIT #2 of SET LSD BIT #2). Bit #4 of the buffer register is then non-destructively transmitted to port D7 (OUTPUT D7 LSD #4), all bits are shifted one position, and the detected data bit is loaded into bit #2 (SHIFT 1 BIT).

Bit #4 of the least significant digit of the buffer register is used to non-destructively transmit all data in the register serially to port D7. This includes the start character, all time data received at port D0, and a stop character received at port D0 and described hereinafter. Bit #2 of the least significant digit is used to load all data into the buffer register including the time data and the stop character received at port D0, but not the start character. The start character is loaded into the buffer register by the microcomputer itself as already explained. Whenever data is detected at port D0, bit #4 is non-destructively transmitted to port D7, all data in the buffer register is shifted one bit position, and bit #2 is loaded with the D0 port data. The microcomputer then checks whether the bit counter has counted up to 30 (BIT CTR=30?). If not, the microcomputer sets a serial data in (SDI) flag (SET SDI FLAG) to indicate that data is being received at the D0 port, the microcomputer increments the bit counter one count (INCR BIT CTR), and the microcomputer enters the TIME routine in order to update the real time register.

After the real time register is updated in the TIME routine, the microcomputer cycles through the KEY, ETME and DISP routines as previously described. See FIG. 2. Thereafter, the microcomputer determines that the SDI flag is set (SDI SET?) in the main program and returns to the SIOL routine at the OSC entry point. See FIGS. 2 and 6.

The microcomputer continues to load serial data bits received at the D0 port into bit #2 of the buffer register, one bit each 1/50 or 1/60 second, i.e., each program loop, while non-destructively shifting the serial data bits previously loaded into the register out of bit #4 to the D7 port one bit each 1/50 or 1/60 second. The bit counter is incremented whenever a bit is shifted out of the buffer register. In all, the buffer register holds 31 bits, the three least significant digit bits, #2, #3 and #4, 24 real time data bits, and a 4 bit stop character. When 31 data bits have been serially loaded into the buffer register, the bit counter will read 30. The microcomputer will then check to determine whether the last 4 bits serially loaded into the buffer register define a stop character (STOP CHAR=3?). In the preferred embodiment described herein, the stop character is a binary 3 or [0011]. If reception of the stop character has been confirmed, the microcomputer resets the bit counter (RESET BIT CTR) and updates or loads the real time register in RAM 36 with the data in the buffer register (LOAD RT REG). At this time, the buffer register data will be the time data received at port D0 and the stop character received at port D0. The microcomputer then resets the SDI flag (RESET SDI FLAG), resets the PF flag (RESET PF FLAG), and returns to the BGN point in the program.

If, when the microcomputer first enters the SIOL routine, the first or second start bit of a start character is not detected, the microcomputer branches through the STBT LOW? and BIT CTR=300? blocks, resets the D7 output port (RESET OUTPUT D7), and increments the bit counter one count (INCR BIT CTR). The microcomputer then enters the TIME routine to update the real time register count.

A start character is produced by clock 10' and is received at port D0 once each second. The start character is a binary 6 or [110] as previously explained. The clock 10 produces a start character at port D7 whenever a start character is received from clock 10'. The start character at port D7 is followed by the 24 time data bits and the 4 bit stop character as these bits are shifted into the clock 10 buffer register in preparation for loading into the real time register. Thus, every second, 31 bits of information are loaded into the buffer register and transmitted from port D7 to serial driver 24. Each data bit is either 1/50 second long (50 hz gating pulses from oscillator 22) or 1/60 second long (60 hz gating pulses from oscillator 22). Accordingly, 31 bits of information are transmitted from port D7 for 31/50 or 31/60 second.

If no start bit is detected for 5 seconds at port D0, the bit counter will have been incremented to 300, and the microcomputer will exit the SIOL routine at the BIT CTR=300? block and enter the SERO routine. In the SERO routine, the updated real time register information is loaded into the buffer register and the buffer register information is serially transmitted to the driver 24 via output port D7 as already described. Thus, upon detecting a malfunction of clock 10' (lack of transmission of real time data to port D0 for 5 seconds), clock 10 jumps from the SIOL routine to the SERO routine. In other words, clock 10 stops operating as a slave clock and starts operating as a master clock off the crystal oscillator signal to ensure continued transmission of real time data to clock 10'' via driver 24.

Operation as Elapsed Timer or Interval Timer

Whether operating as a master, sub-master or slave clock, the programmed digital secondary clock 10 can be operated as an elapsed timer or as an interval timer.

Figure 9:
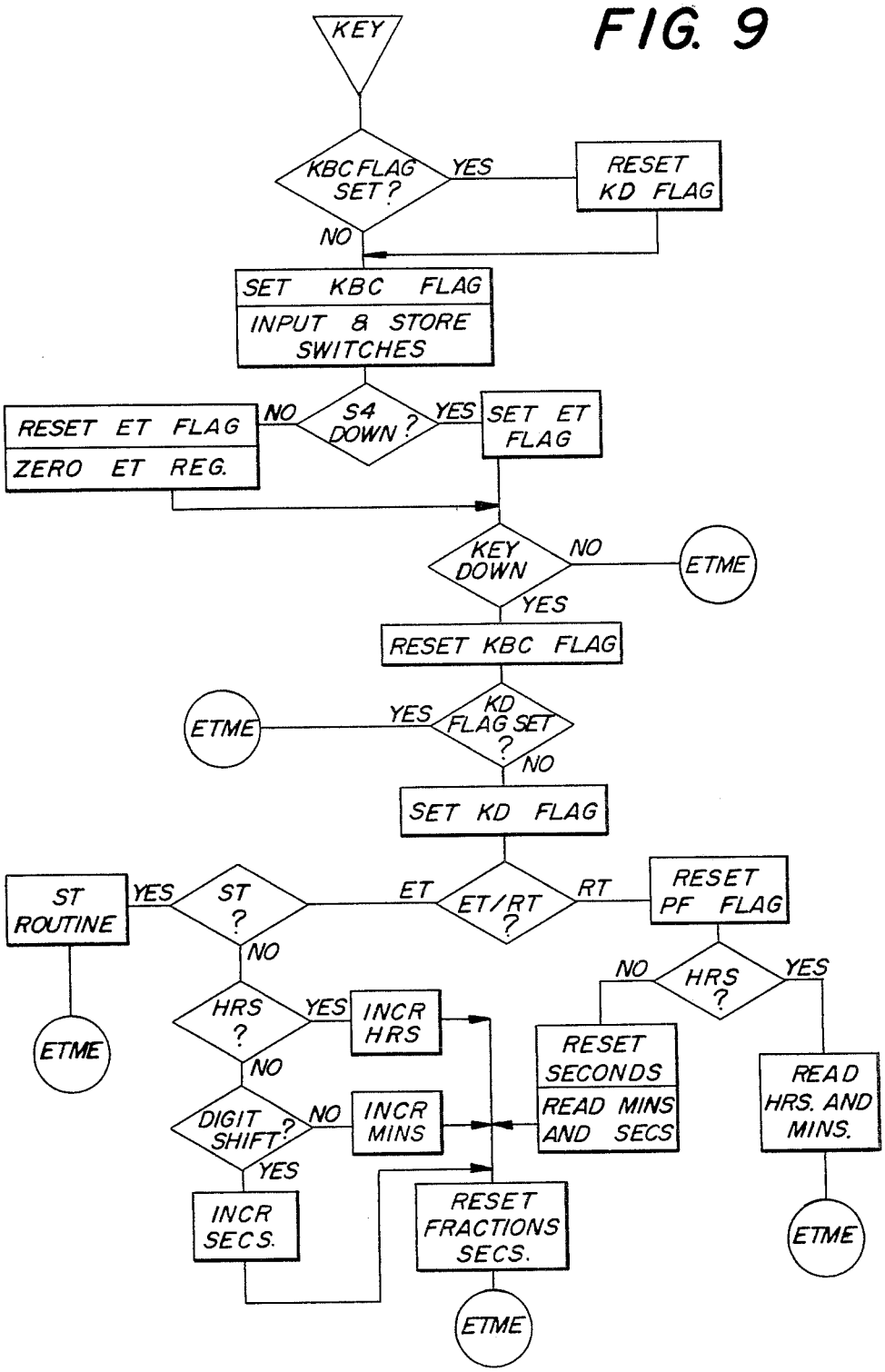
FIG. 9 is a flow chart of the KEY routine primarily for operation of the clock as an elapsed timer or as an interval timer.

Referring to FIG. 9, when the microcomputer 12 enters the KEY routine, the microcomputer determines whether a keyboard clear (KBC) flag has been set (KBC FLAG SET?). The KBC flag will be set if none of the keys S1–S5 on keyboard 30 have been depressed or closed. If none of the keys S1–S5 have been depressed, the microcomputer 12 resets a key down (KD) flag (RESET KD FLAG) and then sets the KBC flag (SET KBC FLAG). The microcomputer then checks and stores the status of the switches S1–S5 by inspecting the input ports PI1–PI4 (INPUT & STORE SWITCHES).

Switch S1 is depressed to preset an interval time count in hours. Switch S2 is depressed to preset an interval time count in minutes and/or seconds. Switch S3 is depressed to start and/or resume an elapsed time count or an interval time count. Switches S1–S3 are momentary pushbutton switches. Switch S4 is an SPST switch which is closed to enable the microcomputer 12 to maintain an elapsed time count or an interval time count. Switch S5 is an SPST switch which is closed to display an elapsed time count, an interval time count or a real time count in hours and minutes or in minutes and seconds. Switch S5 may also be used in conjunction with switch S2 to preset an interval time count in seconds.

If switch S4 is closed (S4 DOWN?), the microcomputer 12 sets an elapsed time (ET) flag (SET ET FLAG) and then checks whether any of the switches S1–S3 and S5 had been depressed (KEY DOWN). If switch S4 has not been closed, the microcomputer 12 resets the ET flag (RESET ET FLAG) and zeroes an elapsed time register in RAM 36 (ZERO ET REG). The elapsed time register is similar in format to the real time register. As described hereinafter, the elapsed time register is incremented whenever the seconds count in the real time register is incremented. After zeroing the elapsed time register, the microcomputer enters the KEY DOWN block and checks the status of switches S1–S3 to determine whether switch S5 had been depressed. If any of the switches S1–S3 had been depressed alone or in combination with switch S5, the microcomputer resets the KBC flag (RESET KBC FLAG) to indicate that the keyboard is not clear.

The microcomputer 12 then checks whether the KD flag has been reset (KD FLAG SET?). If the KD flag has been reset, the microcomputer 12 sets the KD flag (SET KD FLAG) and then branches at the ET/RT? block to the elapsed time mode (ET) or the real time mode (RT) depending upon whether the ET flag was set, i.e., whether switch S4 was operated.

If the ET flag was set, the microcomputer 12 enters the elapsed time (ET) mode. In the elapsed time mode, the microcomputer 12 checks the status of switch S3 (ST?). Switch S3 is depressed to initiate operation in the elapsed time mode. If the switch S3 has been depressed, the microcomputer 12 enters a ST routine wherein a ST flag is set. The microcomputer 12 then exits the KEY routine and enters the elapsed time (ETME) routine. See FIG. 10.

In the ETME routine, the microcomputer confirms that the ET and ST flags are set (ET FLAG SET? and ST FLAG SET?) and then checks the status of a CT flag (CT FLAG SET?). The CT flag is used to indicate whether the elapsed time mode has just been entered for the first time or whether the microcomputer 12 has executed one or more program cycles (each cycle being 1/50 second or 1/60 second long) in the elapsed time mode. If the CT flag has not been set, it indicates that the microcomputer 12 has just entered the elapsed time mode. Accordingly, the microcomputer 12 sets the CT flag (SET CT FLAG) and stores the units of seconds count maintained in the real time register (STORE USRT).

The microcomputer 12 then checks the status of the elapsed time register (ET REG=0). When the microcomputer 12 first enters the elapsed time mode, the elapsed time register will be zero. Accordingly, the microcomputer resets an up/down (U/D) flag (RESET U/D FLAG). The U/D flag is used to indicate whether the elapsed time register is to be incremented from zero to provide an elapsed time count or decremented from a preset count to provide an interval time count. The microcomputer enters the DISP routine and causes the display 28 to display the zero contents of the elapsed time register.

Each of the foregoing operations occur during a 1/50 second or 1/60 second interval depending upon the frequency of the INT port signal (50 hz or 60 hz). The microcomputer 12 then re-enters the KEY routine during the next 1/50 or 1/60 second interval. See FIG. 9. The microcomputer checks the status of the KBC flag. Since the KBC flag will have been reset during the first 1/50 or 1/60 second interval in the elapsed time mode, the microcomputer does not reset the KD flag but merely sets the KBC flag. This indicates that the keyboard is not clear and that one of the switches S1–S3, namely switch S3, has been depressed. Assuming that operation is to be continued in the elapsed time mode, switch S4 is maintained closed, and the ET flag remains set. Accordingly, the microcomputer 12 exits the KEY DOWN block and enters the ETME routine. See FIG. 10.

In the ETME routine, the microcomputer 12 again checks the status of the ET, ST and CT flags. Since each of the flags will have been set in the first 1/50 or 1/60 second interval, the microcomputer 12 compares the stored value of the units of seconds in the real time register to the current value of the units of seconds in the real time register (COMPARE USRT TO OLD VALUE). Assuming that the real time register has not been updated in the TIME routine to a new units of seconds value, the microcomputer leaves the=? block, enters the DISP routine, and causes the display 28 to continue to display the zero contents of the elapsed time register.

If, however, the units of seconds value of the real time register has been updated to a new value, the micrcomputer 12 stores the new value (STORE NEW VALUE USRT) and checks the status of the U/D flag (U/D FLAG SET?). Since the U/D flag was reset in the first 1/50 or 1/60 second interval, the microcomputer 12 enters a UP CTR routine wherein the units of seconds value in the elapsed time register is incremented. The microcomputer then enters the DISP routine and the new contents of the elapsed time register are displayed on display 28.

The units of seconds value of the elapsed time register is incremented whenever the units of seconds value of the real time register is incremented, i.e., when the units of seconds value of the real time register is updated. The contents of the elapsed time register are displayed on display 28 as previously explained during operation in the elapsed time mode.

If it is desired to temporarily stop the elapsed time count, the switch S3 is momentarily depressed a second time. The second depression of the S3 switch is detected by the microcomputer 12 in the KEY DOWN block in the KEY routine. See FIG. 9. The microcomputer 12 resets the KBC flag, sets the KD flag, and enters the ST routine. In the ST routine, the ST flag is reset, and the microcomputer 12 enters the ETME routine. See FIG. 10.

In the ETME routine, the microcomputer branches to the DISP routine from the ST flag SET? block. The microcomputer computer 12 causes the display 28 to display the contents of the elapsed time register. Although the real time register is continuously being updated at the 50 hz or the 60 hz rate, the microcomputer 12 does not update the elapsed time register contents when switch S4 is depressed a second time. Accordingly, the elapsed time register holds the elapsed time count, and the count is held on display 28.

In the following 1/50 or 1/60 second interval, the microcomputer 12 cycles through the KEY DOWN block in the KEY routine, enters the ETME routine, and branches off the ST FLAG SET? block to the DISP routine. The microcomputer 12 holds the elapsed time register count for all ensuing 1/50 or 1/60 second intervals, causing the count to be displayed on display 28.

If it is desired to resume the elapsed time count, the switch S3 is temporarily depressed a third time. The microcomputer 12 detects the depression of the switch in the KEY DOWN block in the KEY routine, resets the KBC flag, sets the KD flag, and enters the ST routine wherein the ST flag is again set. The microcomputer 12 enters the ETME routine. See FIG. 10.

In the ETME routine, the microcomputer 12 checks the status of the CT flag. Since the CT flag was set in response to the first depression of the switch S3, and was never reset, the microcomputer 12 compares the units of seconds value of the real time register to the stored value. If the current units of seconds value and the stored units of seconds value do not match, the microcomputer checks the status of the U/D flag. Since the U/D flag was reset in response to the first depression of the switch S3, the microcomputer 12 enters the UP CTR and DISP routines wherein the elapsed time register contents are incremented on second and displayed on display 28.

Thereafter, the foregoing cycles of operations are repeated, treating the third depression of the S3 switch as an initial or first depression. In other words, the elapsed time count is resumed by the microcomputer 12 and may be interrupted, and again resumed, by further depressions of the S3 switch.

In operation of clock 10 as an interval timer, the elapsed time register is preset to the desired time value by depression of switches S1 and S2 alone or in combination with switch S5. Thereafter, switch S3 is depressed to initiate operation of the microcomputer 12 as an interval timer.

Each time switch S1 is momentarily depressed, the hours portion of the elapsed time register is incremented one hour. Each time switch S2 is depressed while switch S5 is open, the minutes portion of the elapsed time register is incremented one minute. If switch S5 is closed while the switch S2 is depressed, the minutes portion of the elapsed time register is not incremented. Instead, the seconds portion of the elapsed time register is incremented one second.

Specifically, in operation as an interval timer, microcomputer 12 cycles through the KEY routine, resetting the KBC flag, setting the KD flag and branching at the ET/RT? block to the elapsed time mode (ET). Since the microcomputer 12 is to be operated as an interval timer, however, switch S3 is not depressed until the switches S1, S2 and S5 have been manipulated to preset the elapsed time register. Accordingly, the microcomputer branches at the ST? block to the HRS? block. The microcomputer 12 checks the status of the S1 switch in the HRS? block. If switch S1 has been depressed, the microcomputer increments the hours portion of the elapsed time register (INCR HRS), resets the fractions of seconds portion of the elapsed time register (RESET FRACTIONS SECS), and enters the ETME routine. See FIG. 10.

In the ETME routine, the microcomputer 12 branches to the DISP routine at the ST FLAG SET? block since the ST flag has not yet been set. The display 28 displays the contents of the elapsed time register, including the preset hours portion of the register.

In the next 1/50 or 1/60 second interval, the microcomputer 12 cycles through the KEY routine to the ST? and HRS? blocks, and the microcomputer again increments the hours portion of the elapsed time register if the switch S1 has again been depressed momentarily. The hours portion of the elapsed time register is successively incremented one count (one hour) for each depression of the switch S1 for ensuing 1/50 or 1/60 second intervals during which switch S1 is depressed. The incremented count in the elapsed time register is displayed by display 28 during each interval.

To preset the minutes portion of the elapsed time register, switch S2 is momentarily depressed while switch S5 is maintained in the open position. The microcomputer 12 cycles through the KEY routine, resetting the KBC flag, setting the KD flag, and branching through the ST? and HRS? blocks without setting the ST flag and without incrementing the hours portion of the elapsed time register. See FIG. 9. In the DIGIT SHIFT? block, the microcomputer checks the status of the S2 and S5 switches. If the S2 switch has been depressed and the S5 switch was open, the microcomputer increments the minutes portion of the elapsed time register and resets the fractions of seconds portion of the register. The microcomputer then enters the ETME routine. See FIG. 10.

In the ETME routine, the microcomputer branches to the DISP routine at the ST FLAG SET? block. The display 28 displays the contents of the elapsed time register including the incremented minutes portion of the register.

The foregoing operations are repeated by the microcomputer 12 for each ensuing 1/50 or 1/60 second interval during which switch S2 is depressed while switch S5 is open. The incremented count in the elapsed time register is displayed by display 28 during each interval.

To preset the seconds portion of the elapsed time register. the switch S2 is depressed while the switch S5 is closed. The microcomputer 12 cycles through the KEY routine, resetting the KBC flag, setting the KD flag, and branching through the ST?, HRS? and DIGIT SHIFT? blocks to the INCR SECS block. See FIG. 9. In the INCR SECS block, the microcomputer 12 increments the seconds portion of the elapsed time register. The microcomputer then resets the fractions of seconds portion of the register and enters the ETME routine. See FIG. 10.

In the ETME routine, the microcomputer 12 branches to the DISP routine at the ST FLAG SET? block. The display 28 displays the contents of the elapsed time register, including the incremented seconds portion of the register.

The foregoing operations are repeated by the microcomputer 12 for each ensuing 1/50 or 1/60 second interval during which switch S2 is depressed while the S5 switch is closed. The incremented count in the elapsed time register is displayed by display 28 during each interval.

Once the hours, minutes and seconds portions of the elapsed time register have been preset to the desired values, by operation of switches S1, S2 and S5, the switch S3 is momentarily depressed to initiate the interval time count. The microcomputer 12 cycles through the KEY routine resetting the KBC flag, setting the KD flag and branching to the elapsed time mode (ET). See FIG. 9. The microcomputer 12 detects the depression of the S3 switch at the ST? block and enters the ST routine wherein the ST flag is set. The microcomputer 12 then enters the ETME routine. See FIG. 10.

In the ETME routine, the microcomputer cycles through the ET FLAG SET? and ST FLAG SET? blocks to the CT FLAG SET? block. Since the CT FLAG SET? block is being entered for the first time following depressions of switch S3, the CT flag is not set. The microcomputer 12, therefore, sets the CT flag and stores the units of seconds value in the real time register. The microcomputer 12 then checks the contents of the elapsed time register. The contents of the elapsed time register will not be zero since the elapsed time register has been preset by manipulation of the S1, S2 and S5 switches as previously described. Accordingly, the microcomputer 12 sets the U/D flag to indicate that the elapsed time register is to be decremented toward a zero count. The microcomputer 12 then enters the DISP routine. The display 28 displays the preset contents of the elapsed time register.

In the next 1/50 to 1/60 second interval following depression of the S3 switch, the microcomputer 12 enters the ETME routine from the KEY DOWN block in the KEY routine. Switch S4 is maintained in the closed position whenever the microcomputer 12 is to be operated as an elapsed timer or an interval timer. Accordingly, the ET flag will have been set when the microcomputer 12 enters the ETME routine. The microcomputer 12 cycles through the ET FLAG SET? and ST FLAG SET? blocks to the CT FLAG SET? block. See FIG. 10. Since the CT flag was set in response to depression of the S3 switch, the microcomputer 12 compares the current value of the units of second portion of the real time register to the stored value. If the current and stored values are the same, the microcomputer 12 enters the DISP routine wherein display 28 displays the contents of the elapsed time register.

If, however, the current and stored values of the units of seconds portion of the real time register do not match, the microcomputer 12 stores the current value of the units of second portion of the real time register. The microcomputer 12 then checks the status of the U/D flag. Since the U/D flag was set in the previous 1/50 or 1/60 second interval, the microcomputer 12 enters the DOWN CTR routine wherein the units of seconds portion of the elapsed time register is decremented one second.

Once the elapsed time register has been decremented one second, the microcomputer 12 checks the elapsed time register count (ET REG=0?). If the count is not zero, the microcomputer 12 checks the D8 output port to determine whether the transistor driven buzzer 32 has been actuated. The buzzer is not actuated until the elapsed time register count is zero. Accordingly, the microcomputer 12 enters the DISP routine, and the display 28 displays the decremented elapsed time register count.

The foregoing operations are repeated by the microcomputer 12 every 1/50 or 1/60 second and the elapsed time register count is decremented one second whenever a change in the units of seconds portion of the real time register is detected. The display 28 displays the contents of the elapsed time register as the register is decremented.

When the elapsed time register count reaches zero, the microcomputer 12 generates a signal on the D8 output port which actuates the transistor driven buzzer 32. This indicates that the microcomputer 12 has timed out the preset interval of time. The microcomputer 12 enters the DISP routine wherein display 28 displays the zero count.

During the next one second interval of time, the elapsed time register will be decremented one second as already described as the real time register is updated. Accordingly, the elapsed time register count will no longer be zero. The buzzer remains active or set for the one second interval in response to the signal produced at the D8 output port which began when the elapsed time register count reached zero. Following the one second interval of time, the microcomputer 12 checks the status of the buzzer (BUZZER SET?), zeroes the elapsed time register (ZERO ET REG), and resets the buzzer (RESET BUZZER) in preparation for operation of the microcomputer as an elapsed timer or as an interval timer. When the buzzer has been reset, the microcomputer 12 resets the U/D flag, the CT flag and the ST flag, and enters the DISP routine. The display 28 displays the zero count in the reset elapsed time register.

The switch S3 can be depressed repeatedly to interrupt and then resume the interval count in the fashion previously described in connection with the elapsed time count.

The microcomputer 12 can be operated as an elapsed timer or as an interval timer by manipulation of the switches S1–S3 and S5 as previously described as long as the switch S4 is maintained in the closed position. To restore the microcomputer 12 to the real time mode of operation (RT), the switch S4 is opened. Accordingly, when the microcomputer 12 cycles through the KEY routine, the microcomputer will determine that switch S4 is open at the S4 DOWN? block. See FIG. 9. The microcomputer will then reset the ET flag and zero the elapsed time register. When switch S4 is opened, none of the switches S1–S3 or S5 will be depressed or closed as operation in the elapsed time mode is not desired. Accordingly, the microcomputer 12 branches to the ETME routine from the KEY DOWN block of the KEY routine.

In the ETME routine, the microcomputer 12 will branch from the ET FLAG SET? block and enter the RESET U/D FLAG block. See FIG. 10. The microcomputer 12 will reset the U/D flag, the CT flag and the ST flag and enter the DISP routine. The display 28 will display the contents of the real time register while ignoring the contents of the elapsed time register.

Format of the Real Time Count in Hours, Minutes, Seconds

Display 28 can display the real time count maintained by the real time register either in tens and units of hours and tens and units of minutes or in tens and units of minutes and tens and units of seconds. The particular format for the display 28 is determined in the KEY routine. See FIG. 9.

The microcomputer 12 cycles through the KEY routine and branches off the ET/RT? block to the real time (RT) mode. The microcomputer 12 resets the power failure (PF) flag and checks the status of the S5 switch in the HRS? block. If the S5 switch is open, the microcomputer reads the hours and minutes portions of the real time register and enters the ETME routine. See FIG. 10.

Since the real time count is to be displayed, the ET flag will not be set. Accordingly, the microcomputer 12 jumps from the ET FLAG SET? block in the ETME routine to the RESET U/D, CT and ST FLAG blocks. The microcomputer 12 then enters the DISP routine wherein the hours and minutes portions of the real time register count are displayed by display 28.

If, however, the S5 switch is closed, the microcomputer 12 branches from the HRS? block to reset the seconds portion of the real time register (RESET SECONDS) and read the minutes and seconds portion of the register (READ MINS AND SECS). The microcomputer 12 resets the fractions of seconds portion of the register and enters the DISP routine via the ETME routine as previously described. In the DISP routine, display 28 displays the minutes and seconds portion of the real time register count.

Selection of the Frequency Base and the Hourly Display Format

The programmed digital clock 10 continuously updates the real time register count at the 50 hz or 60 hz rate of the signal appearing at the INT input whether the clock is operated as a master, sub-master or slave clock. In addition, as a slave clock, the clock 10 can synchronously receive serial digital information and transmit the same at the 50 hz or 60 hz rate. Thus, the rate at which the real time register count is updated is determined by the frequency of the ac line signal or, if the ac line is not connected to the INT port, by the frequency of the crystal oscillator signal. And the rate at which serial data is received and transmitted by the clock 10, when operated as a slave clock, is also determined by the frequency of the crystal oscillator signal. Thus, in the preferred embodiment described herein, the rate of reception and transmission of the serial data is the same as the rate at which the real time register count is updated.

The rate at which the real time register count is updated is determined by the mode in which the fraction of seconds portion of the real time register is counted. The mode of counting of the fractions of seconds portion of the real time register is determined in the TIME routine. See FIG. 8.

In the TIME routine, the microcomputer 12 checks whether the power failure (PF) flag has been reset (PF FLAG SET?). The PF flag is reset as described in detail hereinafter. If the PF flag has been reset, the microcomputer 12 checks the PI2 input port to determine whether the microcomputer will cycle through the program at the 50 hz rate or at the 60 hz rate (FREQ MODE). If operation is to proceed at the 50 hz rate, a diode 52 is connected between the D4 output port and the PI2 input port. The microcomputer 12 pulses the D4 port and checks the PI2 input for a return pulse. If the pulse is received at the PI2 port, this indicates that the diode 52 has been connected and that operation is proceed at the 50 Hz rate. Accordingly, every 1/50 second the microcomputer 12 increments the fractions of seconds portion of the real time register, and the fractions of seconds portion of the register counts modulo 50 (INCREMENT FR. MOD. 50 and INCREMENT RT REG).

To operate the microcomputer 12 at the 60 hz rate, the diode 52 is not connected between the D4 and DI2 ports. When the microcomputer 12 emits a pulse at the D4 output, the pulse is not received at the PI2 input. Accordingly, the microcomputer 12 determines that operation is to proceed at the 60 hz rate. Every 1/60 second, the microcomputer increments the fractions of seconds portion of the real time register, and the fractions of seconds portion of the register counts modulo 60 (INCREMENT FR. MOD. 60 and INCREMENT RT REG).

When the units fractions of seconds portion of the real time register has reached the modulo count, either 50 or 60, it resets itself. Eventually, the units fractions of seconds portion propogates a carry to the tens fractions of seconds portion of the register. The tens fractions of seconds portion of the real time register is incremented one count in response to the carry. The units and tens of each portion of the real time register are incremented by the carry of the preceding portion of the register until the tens of hours portion of the register has been incremented one count. Once the tens of hours portion of the real time register has been incremented one count (TENS INC?), the microcomputer 12 advances to the HRS MODE block to determine the format of the display of the hours portion of the register, viz., 1–12 hours or 0–23 hours.

The microcomputer 12 determines the format of the display of the hours portion of the register in the HRS MODE? block in the TIME routine. The hours portion of the real time register may be incremented from zero to 12 hours or from zero to 23 hours depending on whether a 12 hour or 24 hour display is desired. If the 24 hour display is desired, a diode 54 is connected between the D4 output port and the PI3 input port. If a 12 hour display is desired, the diode 54 is not connected between the D4 and PI3 ports. The presence or absence of the diode is detected by the microcomputer 12 by pulsing the D4 port and checking the PI3 port for a return pulse. If a return pulse is detected, the microcomputer 12 determines that operation is to proceed in connection with a 24 hour display. If the pulse is not detected at the PI3 port, the microcomputer 12 determines that operation is to proceed in connection with a 12 hour display.

If the microcomputer 12 determines that operation is to proceed in connection with the 24 hour display, the microcomputer checks the tens of hours portion of the real time register. If the tens of hours portion of the register contains a count of 2 (TENS=2?), indicating 20 hours, the microcomputer then checks the units of hours portion of the register. If the units of hours portion of the register contains a count of 4 (UNITS≧4), indicating 4 hours, the microcomputer resets the tens and the units of hours portion of the real time register to 00. The microcomputer then enters the KEY routine.

If either the tens of hours portion of the register contains a count less than 2 (less than 20 hours counted) or the units of hours portion of the register contains a count less than 4 (less than 24 hours counted), the microcomputer 12 does not reset either the tens or the units hours portion of the register but, instead, directly enters the KEY routine. In this manner, the microcomputer 12 controls the mode of counting of the tens and units hours portion of the real time register so that the hours portion of the register counts from 0–23 hours.

Similarly, if the microcomputer 12 determines that operation is to proceed in connection with the 12 hour display, the microcomputer controls the mode of counting of the hours portion of the real time register so that the hours portion of the register counts from 1–12 hours. Specifically, the microcomputer 12 checks the tens of hours portion of the register to determine whether a count of 1 has been reached (TENS=1?). A count of 1 in the tens of hours portion of the register indicates 10 hours. If the count of 1 has been reached, the microcomputer 12 then checks the units of hours portion of the register to determine whether a count of 3 has been reached (UNITS≧3?). A count of 3 in the units portion of the register indicates 3 hours. When the tens of hours portion of the register has reached a count of 1 and the units of hours portion of the register has reached a count of 3, this indicates a combined count of 13 hours. At the 13 hour count, the microcomputer 12 resets the tens and units of hours portion of the real time register to 01. The microcomputer 12 then enters the KEY routine. In this manner, the microcomputer 12 controls the mode of counting of the tens and units hours portion of the real time register so that the hours portion of the register counts 1–12 hours.

The Power Failure (PF) Flag

The programmed digital clock 10 responds to a power failure by displaying 0:00 time when power is restored. The display will hold the 0:00 time until the real time count is corrected in the SYNC routine, if clock 10 is being operated as a sub-manner clock, or until the microcomputer passes through the KEY routine, if clock 10 is being operated as a master clock, or until the microcomputer passes through the SIOL routine if clock 10 is being operated as a slave clock.

Whether the programmed digital clock 10 is being operated as a master clock, sub-master clock or slave clock, upon restoration of power after a failure, the microcomputer 12 will set the power failure (PF) flag. See FIG. 2. The real time register in RAM 36 will be reset to zero and the display 28 will display 0:00 time.

If the programmed digital clock 10 is being operated as a sub-master clock, the real time register and the display 28 will not be updated until a correction signal has been received and processed in the SYNC routine. Until that time, the microcomputer 12 will cycle through the SYNC and SERO routines to the TIME routine. Normally, in the TIME routine, the real time register is updated. Since, however, the PF flag has not yet been reset, the microcomputer 12 exits the TIME routine at the PF FLAG RESET? block and enters the KEY routine without updating the real time register. See FIGS. 8 and 9. Once the correction signal has been received and processed in the SYNC routine, however, the PF flag is reset in the RESET PF FLAG block. See FIG. 5. Thereafter, the microcomputer 12 cycles through the TIME routine and updates the real time register count as already described. The display 28 displays the corrected real time count and thereafter the continuously updated count.

When the programmed digital clock 10 is operated as a master clock, the real time register is not updated from the zero count and the display is not updated from the 0:00 time until the PF flag is automatically reset in the KEY routine. See FIG. 9. In the KEY routine, the PF flag is reset at the RESET PF FLAG block immediately prior to the determination of the format of the hours display previously described. Thereafter, the microcomputer updates the real time register count and the display 28 as already explained.

When the programmed digital clock is operated as a slave clock, the real time register is not updated from the zero count and the display is not updated from the 0:00 time until the PF flag is automatically reset in the SIOL routine. See FIG. 6. In the SIOL routine, the PF flag is reset at the RESET PF FLAG block after the stop character has been received and tested. Thereafter, the microcomputer updates the real time register count and the display 28 as already explained.

The present invention may be embodied in other specific forms without departing from the spirit or essential attributes thereof and, accordingly, reference should be made to the appended claims, rather than to the foregoing specification as indicating the scope of the invention.

I claim:

1. A programmed digital secondary clock, comprising:

real time counting means adapted for selective connection to a reference frequency line carrying a reference frequency signal for maintaining a count of real time based on the reference frequency signal, serial data transmitting means adapted for connection to a slave secondary clock for transmitting the real time count maintained in said real time counting means to the slave secondary clock in serial data format at said reference frequency, display means for numerically displaying the real time count maintained by said real time counting means, serial data receiving means adapted to receive a real time count in serial data format, means for updating the real time count maintained by said real time counting means with the real time count received in serial data format, and correction means adapted for selective connection to a master clock or to an electronic receiver for correcting the real time count maintained by said real time counting means in response to the width of a correction pulse signal produced by said master clock or a correction signal produced by said electric clock receiver.

2. The programmed digital secondary clock according to claim 1 including means for selectively maintaining an incremented count of elapsed time, means for selectively interrupting the elapsed time count, means for selectively resuming said elapsed time count, and means for causing said numerical display to display said elapsed time count.

3. The programmed digital secondary clock according to claim 1 including means for selectively maintaining a decremented count of interval time, means for selectively presetting said count of interval time, means for selectively interrupting said count of interval time, means for selectively resuming said count of interval time, and means for causing said numerical display means to display said interval count.

4. The programmed digital secondary clock according to claim 2 including means for indicating that said decremented count of interval time is zero.

5. The programmed digital secondary clock according to claim 1 including detecting means for detecting the presence or absence of said real time count in serial data format received by said serial data receiving means, oscillator means for generating a reference frequency digital pulse train, and means for causing said real time counting means to maintain a count of real time based on said reference frequency pulse train if said detecting means detects the absence of said real time count in serial data format for a preselected interval of time.

6. A programmed digital secondary clock, comprising:

a real time register for maintaining a count of real time based on a reference frequency signal, said real time register having a stage for maintaining a count of units of seconds based on said reference frequency signal, a buffer register operatively associated with said real time register, means for detecting a change in said units of seconds count maintained by said real time register, means for loading said real time count in said buffer register when said change in said units of seconds count is detected, means for serially shifting said loaded real time count out of said buffer register at said reference frequency to a slave secondary clock, means for numerically displaying said real time count maintained by said real time register, means for receiving a real time count in serial data format at said reference frequency, means for loading said real time count received in serial data format into said buffer register at said reference frequency, and means for transferring said real time count loaded into said buffer register to said real time register at a frequency of at least once each second.

7. The programmed digital secondary clock according to claim 6 including means adapted for selective connection to a master clock or to an electronic receiver for correcting the real time count maintained in said real time register in response to a correction signal produced by said master clock or a correction signal produced by said electronic receiver.

8. The programmed digital secondary clock according to claim 6 including an elapsed time register for selectively maintaining an incremented count of elapsed time based on said reference frequency signal, means for selectively interrupting the elapsed time count, means for selectively resuming said elapsed time count, and means for causing said numerical display means to display said elapsed time count.

9. The programmed digital secondary clock according to claim 6 including a time register for maintaining a decremented count of interval time, means for selectively presetting said time register, means for selectively interrupting said decremented count of interval time, means for selectively resuming said decremented count of interval time, and means for causing said numerical display means to display said decremented count of interval time.

10. The programmed digital secondary clock according to claim 9 including means for indicating that said count of interval time is zero.

11. A programmed digital secondary clock, comprising:

a real time register for maintaining a count of real time based on a reference frequency signal, said real time register having a stage for maintaining a count of units of seconds based on said reference frequency signal, a buffer register operatively associated with said real time register, means for detecting a change in said real time count maintained by said real time register, means for loading said real time count in said buffer register when said change in said units of seconds count is detected, means for serially shifting said loaded real time count out of said buffer register at said reference frequency to a slave secondary clock, means for numerically displaying said real time count maintained by said real time register, means adapted for selective connection to a master clock or to an electronic receiver for periodically correcting the real time count maintained in said real time register in response to a correction signal produced by said master clock or a correction signal produced by said electronic receiver, means for receiving a real time count at said reference frequency in serial data format, means for loading said real time count received in serial data format into said buffer register at said reference frequency, and means for transferring said real time count loaded into said buffer register to said real time register at a frequency of at least once each second.

12. The programmed digital secondary clock according to claim 1, 8 or 11 including detecting means for detecting the presence or absence of said received real time count in serial data format, oscillator means for generating a reference frequency digital pulse train, and means for causing said real time counting means to maintain a count of real time based on said reference frequency pulse train if said detecting means detects the absence of said real time count in serial data format for a preselected interval of time.

13. The programmed digital secondary clock according to claim 11 including means for selectively maintaining an incremented count of elapsed time, means for selectively interrupting the elapsed time count, means for selectively resuming said elapsed time count, and means for causing said numerical display to display said elapsed time count.

14. The programmed digital secondary clock according to claim 11 including means for selectively maintaining a decremented count of interval time, means for selectively presetting said count of interval time, means for selectively interrupting said count of interval time, means for selectively resuming said count of interval time, and means for causing said numerical display means to display said interval count.

15. The programmed digital secondary clock according to claim 14 including means for indicating that said decremented count of interval time is zero.

16. The programmed digital secondary clock, comprising:

real time counting means adapted for selective connection to a reference frequency line carrying a reference frequency signal for maintaining a count of real time based on the reference frequency signal, serial data transmitting means adapted for connection to a slave secondary clock for transmitting the real time count maintained in said real time counting means to the slave secondary clock in serial data format at said reference frequency, display means for numerically displaying the real time count maintained by said real time counting means, and correction means adapted for selective connection to a master clock or to an electronic receiver for correcting the real time count maintained by said real time counting means in response to a correction pulse signal produced by said master clock or by said electronic receiver, including means for detecting the pulse width of said correction pulse signal and for correcting the real time count depending on the detected pulse width of said correction pulse signal.

17. A programmed digital secondary clock, comprising:

a real time register for maintaining a count of real time based on a reference frequency signal, said real time register having a stage for maintaining a count of units of seconds based on said reference frequency signal, a buffer register operatively associated with said real time register, means for detecting a change in said units of seconds count maintained by said real time register, means for loading said real time count in said buffer register when said change in said units of seconds count is detected, means for serially shifting said loaded real time count out of said buffer register at said reference frequency to a slave secondary clock, means for numerically displaying said real time count maintained by said real time register, means adapted for selective connection to a master clock or to an electronic receiver for correcting the real time count maintained in said real time register in response to a correction pulse signal produced by said master clock or by said electronic receiver, including means for detecting the pulse width of said correction pulse signal and for correcting the real time count depending on the detected pulse width of said correction pulse signal.

* * * * *